US011837811B2

(12) United States Patent
Sugaya et al.

(10) Patent No.: US 11,837,811 B2
(45) Date of Patent: Dec. 5, 2023

(54) PLUG CONNECTOR, RECEPTACLE CONNECTOR, AND ELECTRIC CONNECTOR

(71) Applicant: Fujikura Ltd., Tokyo (JP)

(72) Inventors: Soichi Sugaya, Tokyo (JP); Yasuyuki Akiyama, Tokyo (JP); Kiyotaka Yamada, Tokyo (JP)

(73) Assignee: Fujikura Ltd., Tokyo (JP)

( * ) Notice: Subject to any disclaimer, the term of this patent is extended or adjusted under 35 U.S.C. 154(b) by 40 days.

(21) Appl. No.: 17/476,912

(22) Filed: Sep. 16, 2021

(65) Prior Publication Data

US 2022/0085540 A1 Mar. 17, 2022

(30) Foreign Application Priority Data

Sep. 17, 2020 (JP) ..... 2020-156709

(51) Int. Cl.
*H01R 12/71* (2011.01)
*H01R 13/42* (2006.01)

(52) U.S. Cl.
CPC ..... *H01R 13/42* (2013.01); *H01R 12/716* (2013.01)

(58) Field of Classification Search
CPC ..... H01R 13/42; H01R 12/716; H01R 13/20; H01R 12/73; H01R 13/405; H01R 13/40
See application file for complete search history.

(56) References Cited

U.S. PATENT DOCUMENTS

| | | | | |
|---|---|---|---|---|
| 7,168,986 | B1 * | 1/2007 | Peng | H01R 12/716 439/607.04 |
| 7,547,236 | B1 * | 6/2009 | Chen | H01R 12/716 439/74 |
| 7,748,994 | B1 * | 7/2010 | Peng | H01R 13/6315 439/74 |
| 10,566,736 | B2 * | 2/2020 | Tanaka | H01R 12/73 |
| 10,581,184 | B2 * | 3/2020 | Tsukashima | H01R 13/20 |
| 10,741,956 | B2 * | 8/2020 | Matsuno | H01R 13/115 |
| 2010/0159717 | A1 * | 6/2010 | Takeuchi | H01R 13/20 439/65 |

(Continued)

FOREIGN PATENT DOCUMENTS

| | | |
|---|---|---|
| JP | 2015-039129 A | 2/2015 |
| JP | 2016-012470 A | 1/2016 |

(Continued)

*Primary Examiner* — Abdullah A Riyami
*Assistant Examiner* — Nelson R. Burgos-Guntin
(74) *Attorney, Agent, or Firm* — Osha Bergman Watanabe & Burton LLP

(57) ABSTRACT

A plug connector mounted on a board and that mates with a receptacle connector includes at least three signal contacts and two power contacts each including a contact portion that contacts the receptacle connector and a block that holds the signal contacts and the power contacts. The block includes a body and a fitting portion that protrudes away from the body and is inserted into a fitting port of the receptacle connector, and the signal contacts and the power contacts are disposed alternately in a row along an arrangement direction and symmetrically about a line that passes through a center position of the plug connector and is orthogonal to the arrangement direction when viewed from a fitting direction to the receptacle connector.

14 Claims, 19 Drawing Sheets

(56) References Cited

U.S. PATENT DOCUMENTS

2013/0149908 A1* 6/2013 Little ..... H01R 12/716 439/660
2013/0260587 A1* 10/2013 Chen ..... H01R 12/712 439/284
2013/0260594 A1* 10/2013 Lee ..... H01R 13/639 439/345
2013/0330943 A1* 12/2013 Sasaki ..... H01R 12/716 439/74
2013/0337681 A1* 12/2013 Little ..... H01R 12/716 439/569
2014/0220830 A1* 8/2014 Kubo ..... H01R 13/04 439/660
2015/0079816 A1* 3/2015 Suzuki ..... H01R 13/6275 439/74
2015/0140840 A1* 5/2015 Nishimura ..... H01R 12/775 439/74
2015/0263464 A1* 9/2015 Arichika ..... H01R 13/6275 439/374
2015/0311610 A1* 10/2015 Little ..... H01R 12/707 439/284
2015/0357729 A1* 12/2015 Uratani ..... H01R 12/716 439/585
2015/0357735 A1* 12/2015 Uratani ..... H01R 12/716 439/660
2015/0380845 A1* 12/2015 Goto ..... H01R 12/73 439/660
2016/0093967 A1* 3/2016 Takenaga ..... H01R 12/716 439/660
2016/0294082 A1* 10/2016 Matsuno ..... H01R 12/716
2017/0005423 A1* 1/2017 Takenaga ..... H01R 13/635
2017/0070014 A1* 3/2017 Kodaira ..... H01R 24/60
2017/0271813 A1* 9/2017 Ge ..... H01R 13/504
2018/0175561 A1* 6/2018 Chen ..... H01R 12/52
2018/0301837 A1* 10/2018 Hoyack ..... H01R 12/7082
2019/0097360 A1* 3/2019 Chen ..... H01R 12/716
2019/0214772 A1* 7/2019 Kodama ..... H01R 12/716
2020/0059024 A1* 2/2020 Chien ..... H01R 12/775
2020/0067217 A1* 2/2020 Ashibu ..... H01R 12/716
2020/0127400 A1* 4/2020 Sasayama ..... H01R 4/02

FOREIGN PATENT DOCUMENTS

JP 6167997 B2 7/2017
JP 6662369 B2 3/2020

* cited by examiner

PLUG CONNECTOR, RECEPTACLE CONNECTOR, AND ELECTRIC CONNECTOR

CROSS-REFERENCE TO RELATED APPLICATIONS

This application claims priority to Japanese Patent Application No. 2020-156709 filed on Sep. 17, 2020, the entire content of which is incorporated herein by reference.

TECHNICAL FIELD

The present invention relates to a plug connector, a receptacle connector, and an electric connector including these connectors.

BACKGROUND

Conventionally, various electric connectors have been used in electrical and electronic equipment, communication equipment, and the like. An electric connector is composed of a plug connector mounted on one board and a receptacle connector mounted on the other board. Electrical connection between the boards can be made by fitting the plug connector to the receptacle connector. Each connector includes signal contacts each including a contact portion that makes contact with the other connector and a connection portion that is mounted on the board, power contacts each including a similar contact portion and a similar connection portion, and an insulator that holds these contacts (e.g., Patent Documents 1 to 4).

Patent Document 1: Japanese Unexamined Patent Application, Publication No. 2016-12470

Patent Document 2: Japanese Unexamined Patent Application, Publication No. 2015-39129

Patent Document 3: Japanese Patent No. 6167997

Patent Document 4: Japanese Patent No. 6662369

Each Patent Document described above discloses a configuration for enhancing the reliability of the fitting between the connectors, and a configuration for miniaturization. In recent years, there is a need to improve the unevenness of insertion and extraction forces in the arrangement direction of the contacts.

SUMMARY OF THE INVENTION

One or more embodiments of the present invention provide a plug connector, a receptacle connector, and an electric connector, with less uneven insertion and extraction forces in the arrangement direction of contacts.

(1) The present invention relates to a plug connector that detachably fits in a receptacle connector as a mating part. The plug connector includes: signal contacts and power contacts each including a contact portion that makes contact with the receptacle connector and a connection portion that is mounted on a board; and a block that arranges and holds the signal contacts and the power contacts. The block includes a body, and a fitting portion that protrudes in a direction away from the body and is inserted into a fitting port of the receptacle connector. The plug connector includes at least three of the signal contacts and at least two of the power contacts. The signal contacts and the power contacts are arranged so as to be alternately arranged in one row along an arrangement direction and so as to be symmetrical about a line orthogonal to a center position in the arrangement direction, when viewed from a direction of fitting to the receptacle connector.

(2) The body of the block may be formed on a board side, and the fitting portion may be formed so as to protrude in a direction further away from the board than the body. When a direction orthogonal to the fitting direction and the arrangement direction is defined as a width direction, sides where the connection portions of the signal contacts protrude in the width direction and sides where the connection portions of the power contacts protrude in the width direction may be arranged in a staggered manner in the arrangement direction.

(3) The plug connector may include fixtures on both ends in the arrangement direction, the fixtures each include a connection portion that is mounted on the board, and the connection portions of the fixtures may protrude on both sides in the arrangement direction.

(4) The present invention relates to a receptacle connector that detachably fits in a plug connector as a mating part. The receptacle connector includes: signal contacts and power contacts each including a contact portion that makes contact with the plug connector and a connection portion that is mounted on a board; and a housing that arranges and holds the signal contacts and the power contacts. The housing includes a bottom wall, two side walls that protrude in a direction away from the bottom wall and extend along an arrangement direction, and two coupling walls that protrude in a direction away from the bottom wall and that couple the two side walls. The bottom wall, the two side walls, and the two coupling walls form a fitting port into which a fitting portion of the plug connector is inserted. The receptacle connector includes at least three of the signal contacts and at least two of the power contacts. The signal contacts and the power contacts each include at least one curved elastic portion between the contact portion and the connection portion. The contact portion, the elastic portion, and the connection portion are provided in this sequence in a direction where each portion extends. A holding portion that is held by the housing is further provided in a part of the elastic portion on a side of the connection portion. The signal contacts and the power contacts are arranged so as to be alternately arranged in one row along the arrangement direction and so as to be symmetrical about a line orthogonal to a center position in the arrangement direction, when viewed from a direction of fitting to the plug connector.

(5) The bottom wall of the housing may be formed substantially parallel to the board. The two side walls and the two coupling walls may be formed so as to protrude in a direction further away from the board than the bottom wall. When a direction orthogonal to the fitting direction and the arrangement direction is defined as a width direction, sides where the connection portions of the signal contacts protrude in the width direction and sides where the connection portions of the power contacts protrude in the width direction may be arranged in a staggered manner in the arrangement direction.

(6) The present invention relates to an electric connector, including the plug connector according to any one of the above (1) to (3) and the receptacle connector according to the above (4) or (5). The plug connector and the receptacle connector detachably fit to each other.

(7) The present invention relates to an electric connector in which a plug connector and a receptacle connector detachably fit to each other. The plug connector includes: signal contacts and power contacts each including a contact portion that makes contact with the receptacle connector and a connection portion that is mounted on a board; and a block that arranges and holds the signal contacts and the power contacts. The block including a body, and a fitting portion that protrudes in a direction away from the body and is inserted into a fitting port of the receptacle connector. The receptacle connector includes: signal contacts and power contacts each including a contact portion that makes contact with the plug connector and a connection portion that is mounted on a board; and a housing that arranges and holds the signal contacts and the power contacts. The housing includes a bottom wall, two side walls that protrude in a direction away from the bottom wall and extend along an arrangement direction, and two coupling walls that protrude in a direction away from the bottom wall and that couple the two side walls. The bottom wall, the two side walls, and the two coupling walls form the fitting port into which the fitting portion of the plug connector is inserted. The signal contacts and the power contacts of the receptacle connector each include at least one curved elastic portion between the contact portion and the connection portion. The contact portion, the elastic portion, and the connection portion are provided in this sequence in a direction where each portion extends. A holding portion that is held by the housing is further provided in a part of the elastic portion on a side of the connection portion. The plug connector includes at least three of the signal contacts and at least two of the power contacts. The signal contacts and the power contacts are arranged so as to be alternately arranged in one row along an arrangement direction and so as to be symmetrical about a line orthogonal to a center position in the arrangement direction, when viewed from a direction of fitting to the receptacle connector. The receptacle connector includes at least three of the signal contacts and at least two of the power contacts. The signal contacts and the power contacts are arranged so as to be alternately arranged in one row along the arrangement direction and so as to be symmetrical about a line orthogonal to a center position in the arrangement direction, when viewed from a direction of fitting to the plug connector.

(8) The body of the block may be formed on a board side. The fitting portion may be formed so as to protrude in a direction further away from the board than the body. The bottom wall of the housing may be formed substantially parallel to the board. The two side walls and the two coupling walls may be formed so as to protrude in a direction further away from the board than the bottom wall. In the plug connector, one of the signal contacts may be arranged at the center position in the arrangement direction, and at least two of the other signal contacts and the at least two power contacts may be arranged so as to be alternately arranged in one row along the arrangement direction and so as to be symmetrical about the line orthogonal to the center position in the arrangement direction.

According to the present invention, it is possible to provide the plug connector, the receptacle connector, and the electric connector, with less uneven insertion and extraction forces in the arrangement direction of the contacts.

DETAILED DESCRIPTION

Embodiments of a plug connector, a receptacle connector, and an electric connector according to the present invention will now be described with reference to the drawings. The plug connector and the receptacle connector of one or more embodiments cooperate with each other to form a board-to-board connector. The board-to-board connector is an electric connector that makes an electrical connection between two boards by fitting a plug connector mounted on one board to a receptacle connector mounted on the other board.

The type and form of the boards are not limited as long as the plug connector and the receptacle connector can be mounted on their respective boards. For example, a rigid board, a flexible board (FPC), a rigid flexible board (rigid FPC board), or the like may be used. In the following description, the bottom face or the lower face of the plug connector and that of the receptacle connector each refer to the face on the side mounted on the board, and the top face refers to the face on the opposite side of the bottom face or the lower face. The mounting is not limited to a surface mounting type where the connector is soldered on the surface of the board, and may be performed by, for example, a dip type method where the connector is inserted into through holes of the board and soldered, or a press fit method. The mounting method is designed in consideration of workability, mounting density of the board, and the like.

In the present specification and the drawings, the XYZ coordinate system is defined as follows. The X-Y plane is a plane substantially parallel to the mounting face of the board. With reference to the orientation of a receptacle connector 20 shown in FIG. 1B, the Y direction is the arrangement direction of the required number of contacts, and is also referred to as a longitudinal direction. The X direction is a direction orthogonal to the Y direction, and is also referred to as a width direction or a lateral direction. The X1 direction is the side where a connection portion 221 of a power contact 220P protrudes. The X2 direction is the side where a connection portion 221 of a signal contact 220S protrudes (see FIG. 2B). The Y1 direction is the right direction in FIG. 1B, and the Y2 direction is the left direction. The Z direction is a direction orthogonal to the X-Y plane, and is also referred to as a fitting direction or a height direction. The Z1 side is the side of the mounting face of the board, and the Z2 side is the side away from the mounting face of the board. In the present specification, "direction" is also referred to as "side". The XYZ coordinate system is used for convenience of description of the embodiments, and is not to be strictly interpreted unless a broader interpretation would be contrary to the spirit of the present invention.

Figure 1A:
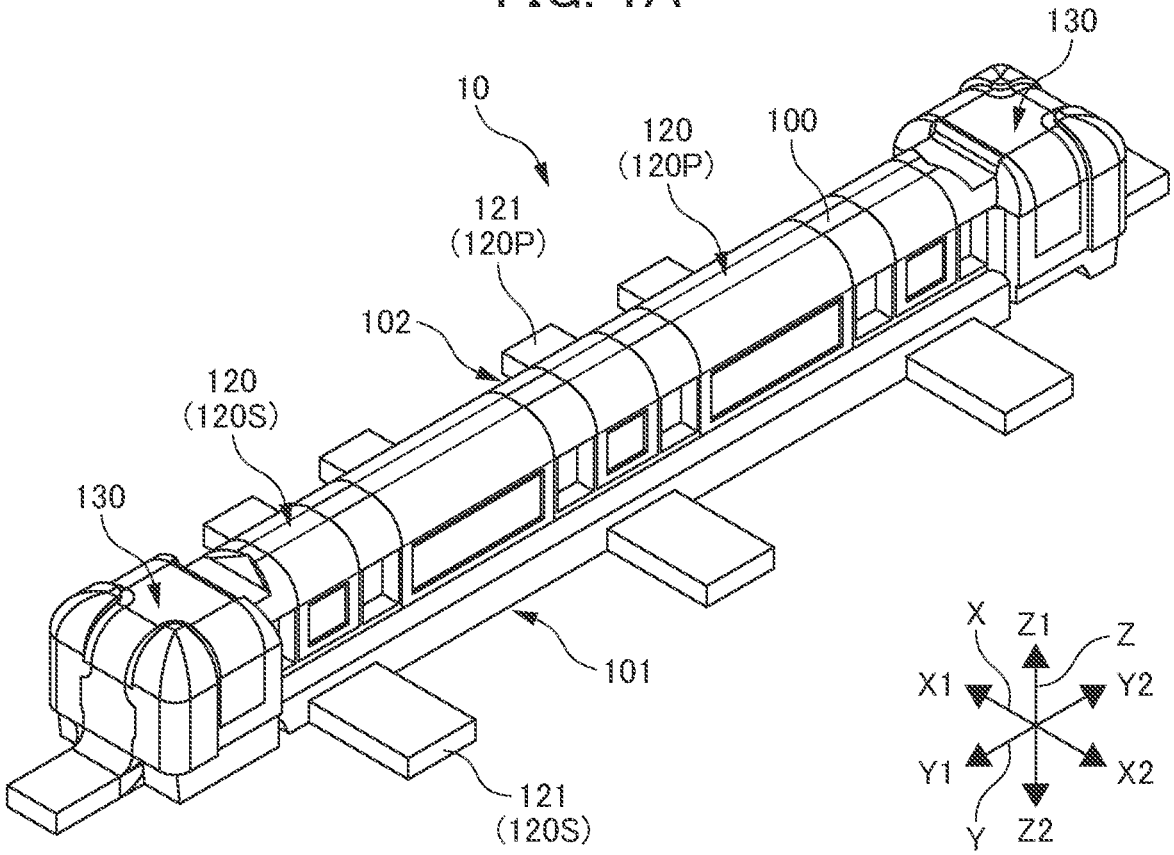
FIG. 1A is a perspective view of a plug connector 10 according to one or more embodiments.
Figure 1B:
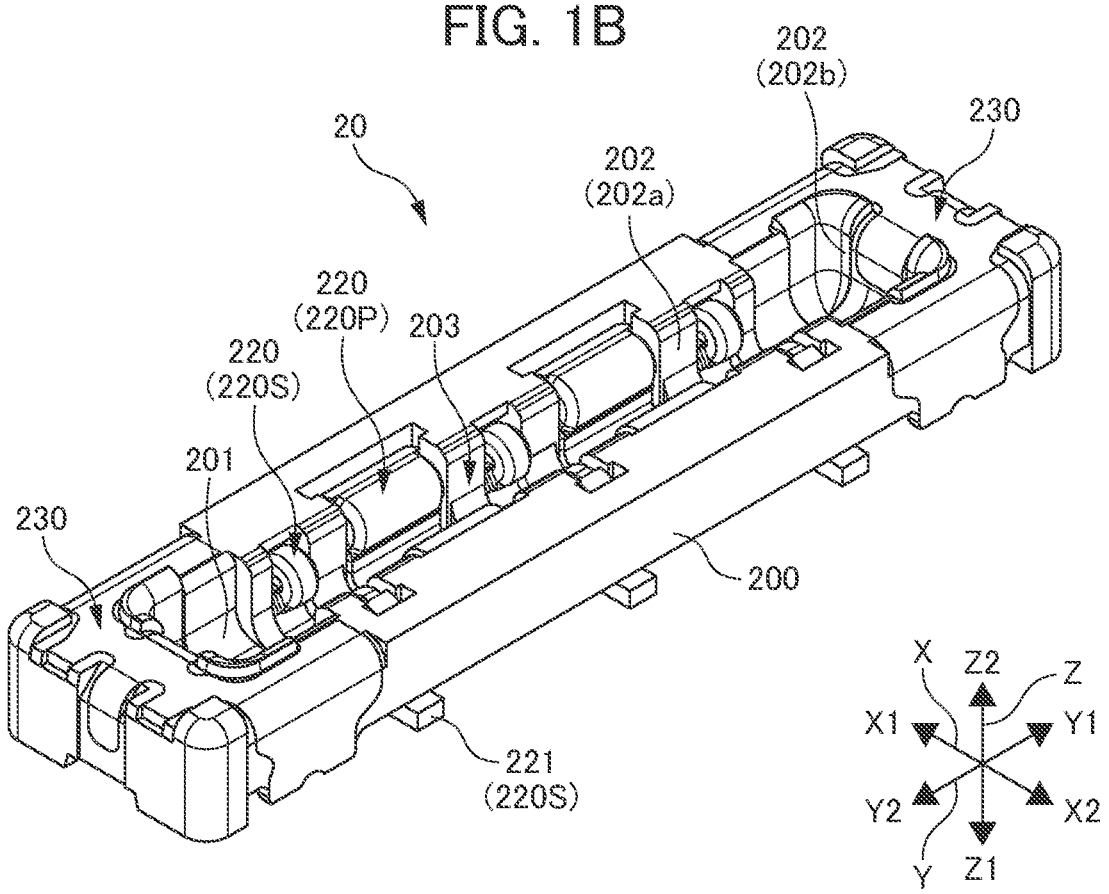
FIG. 1B is a perspective view of a receptacle connector 20 according to one or more embodiments.
Figure 2A:
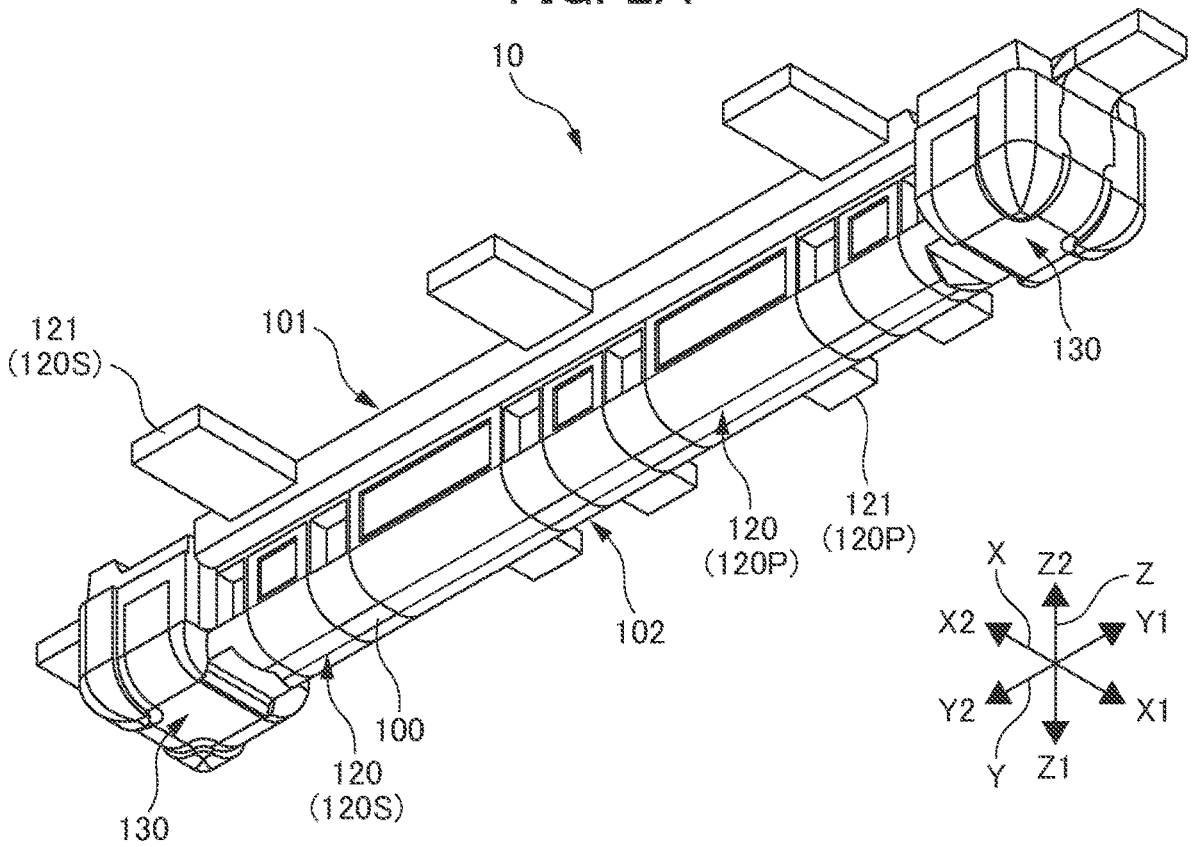
FIG. 2A is a perspective view of the plug connector 10 as viewed from a direction different from that of FIG. 1A.
Figure 2B:
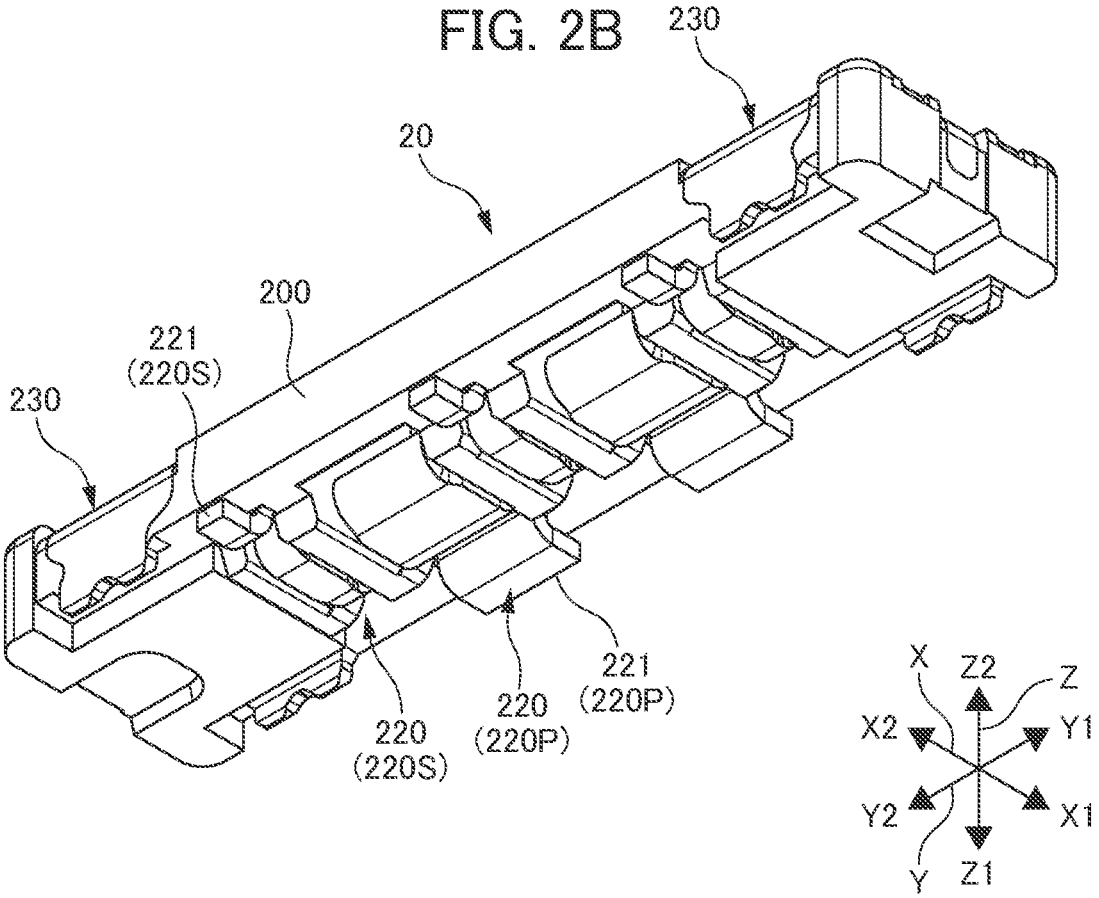
FIG. 2B is a perspective view of the receptacle connector 20 as viewed from a direction different from that of FIG. 1B.
Figure 3:
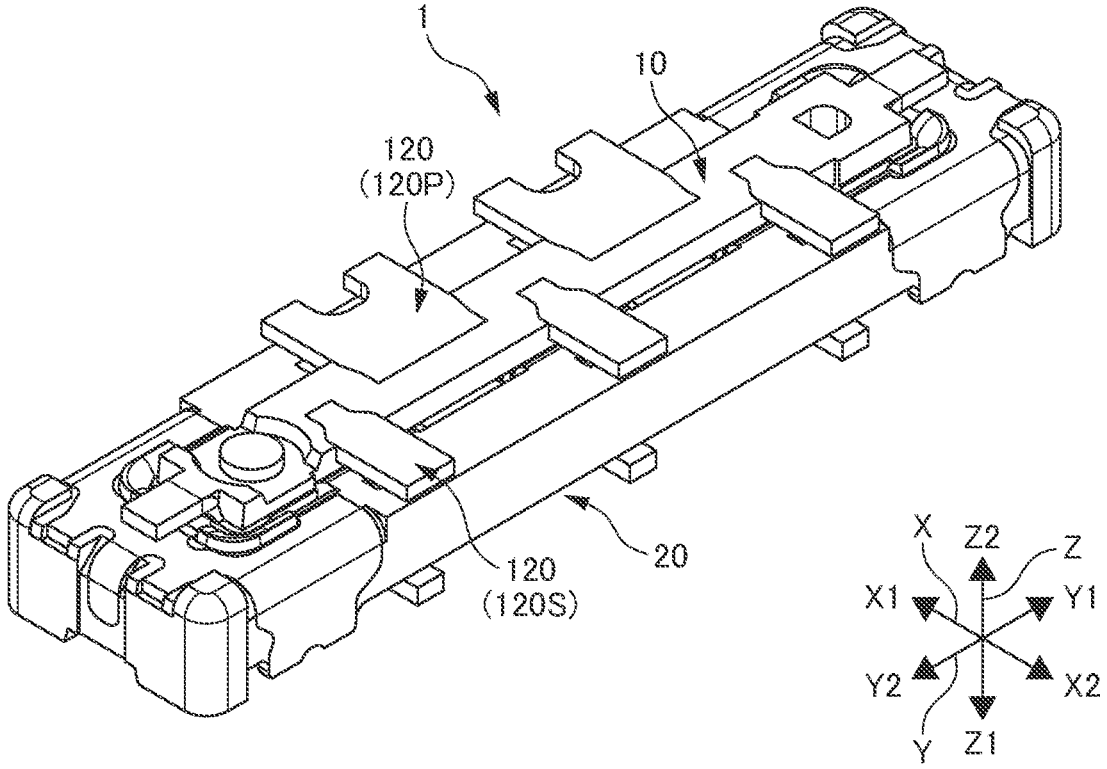
FIG. 3 is a perspective view of a board-to-board connector according to one or more embodiments in a state of fitting the plug connector 10 to the receptacle connector 20.

FIGS. 1A, 1B, 2A, and 2B each show a plug connector 10 or the receptacle connector 20, which constitutes an electric connector 1. FIG. 3 shows a state of fitting the plug connector 10 to the receptacle connector 20. FIG. 1A defines the upper side of the drawing as the Z1 side to indicate the arrangement of plug contacts 120 (described later) of the plug connector 10. As shown in FIG. 2A, the plug connector 10 is fitted to the receptacle connector 20 (see FIG. 2B) in the orientation where the plug contacts 120 are on the Z1 side (lower side of the drawing).

The plug connector 10 and the receptacle connector 20 can be attached to and detached from each other by bringing them closer or separating them in the Z direction. Specifically, by bringing the plug connector 10 shown in FIG. 1A (FIG. 2A) and the receptacle connector 20 shown in FIG. 1B (FIG. 2B) closer, both connectors can be fitted to each other, as shown in FIG. 3. In the fitting state shown in FIG. 3, the fitting of both connectors can be released by separating the plug connector 10 and the receptacle connector 20.

(Plug Connector 10)

Figure 4:
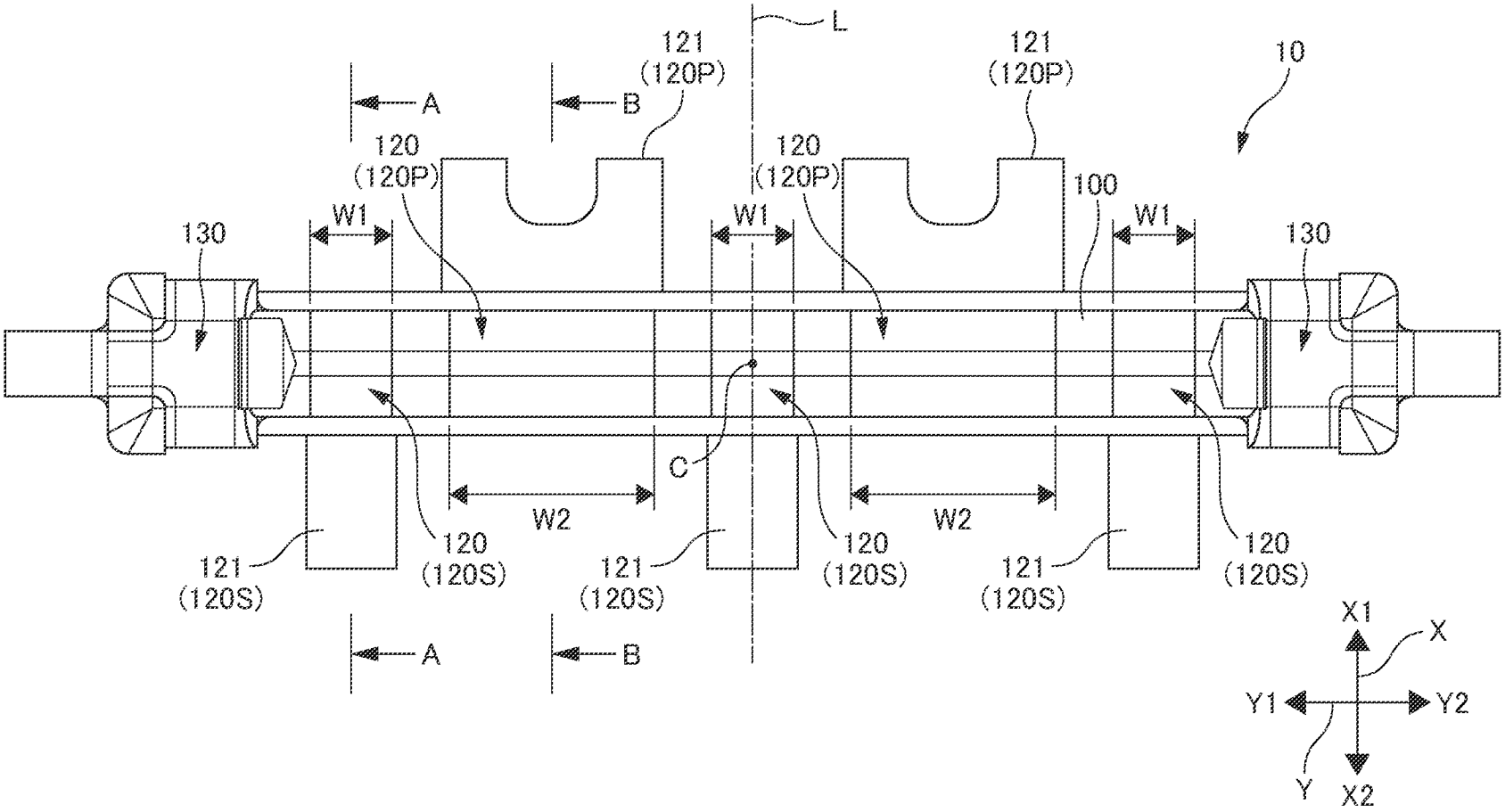
FIG. 4 is a plan view of the plug connector 10.
Figure 5A:
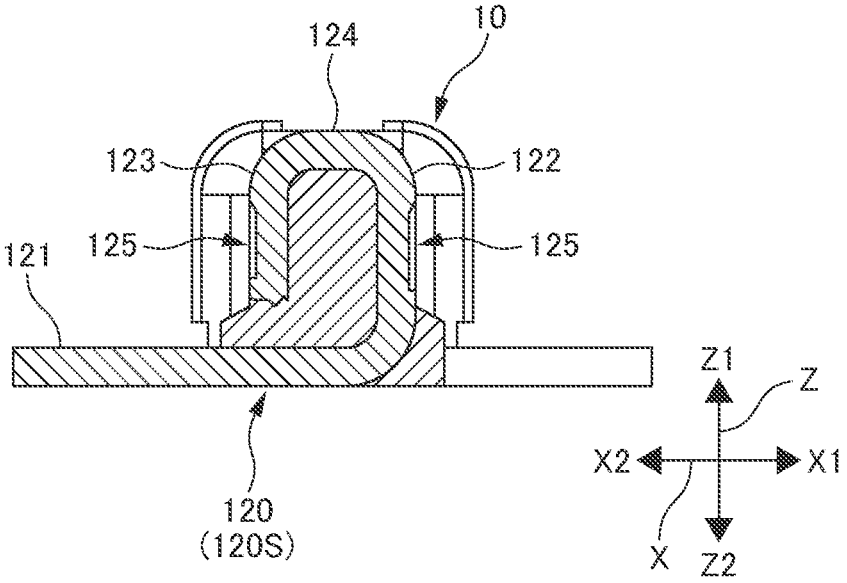
FIG. 5A is a cross-sectional view taken along line A-A in FIG. 4.
Figure 5B:
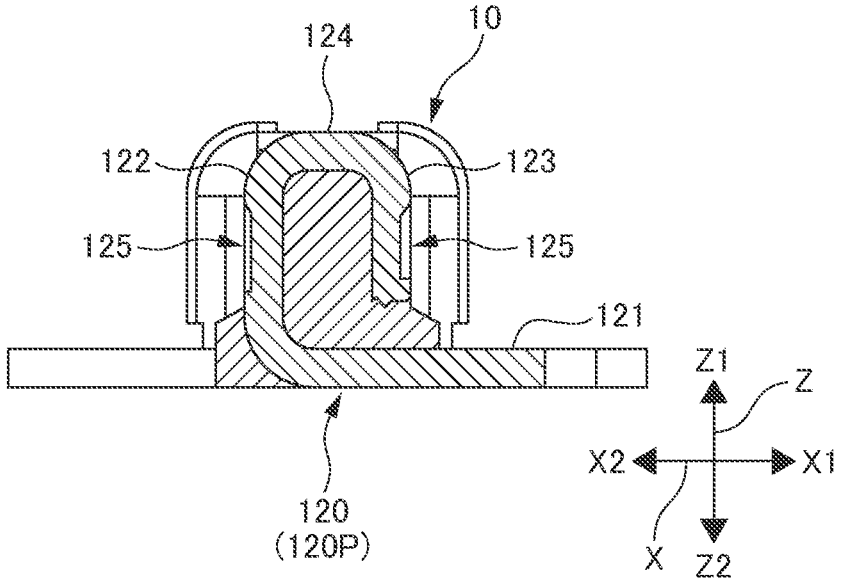
FIG. 5B is a cross-sectional view taken along line B-B in FIG. 4.
Figure 6A:
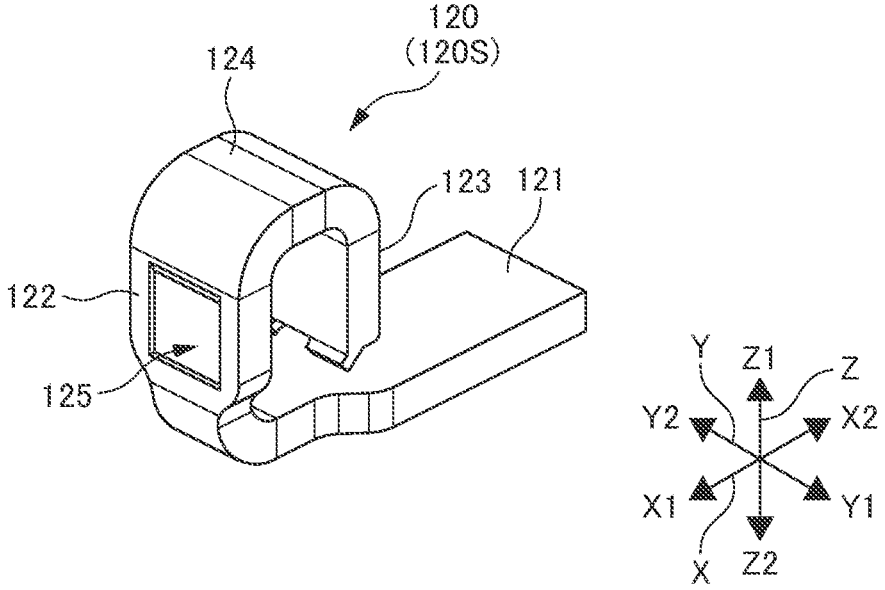
FIG. 6A is a perspective view of a signal contact 120S according to one or more embodiments.
Figure 6B:
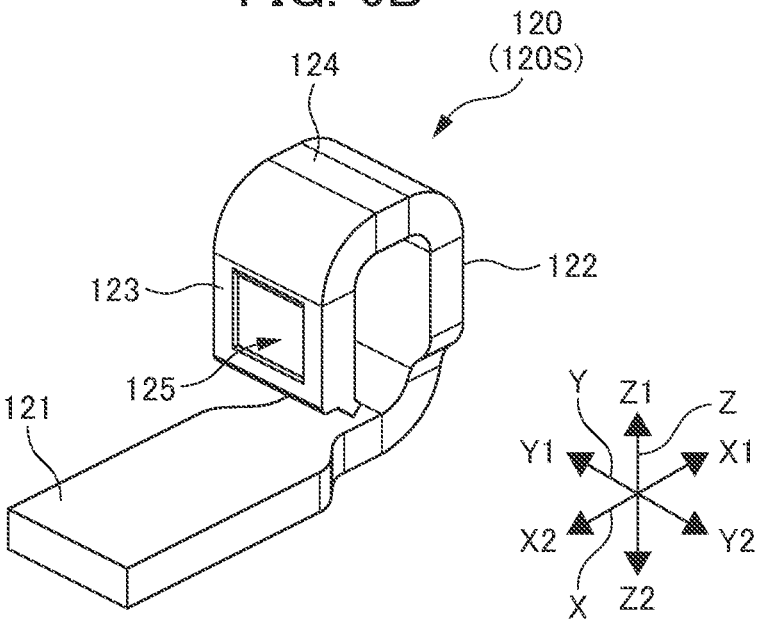
FIG. 6B is a perspective view of the signal contact 120S.
Figure 7A:
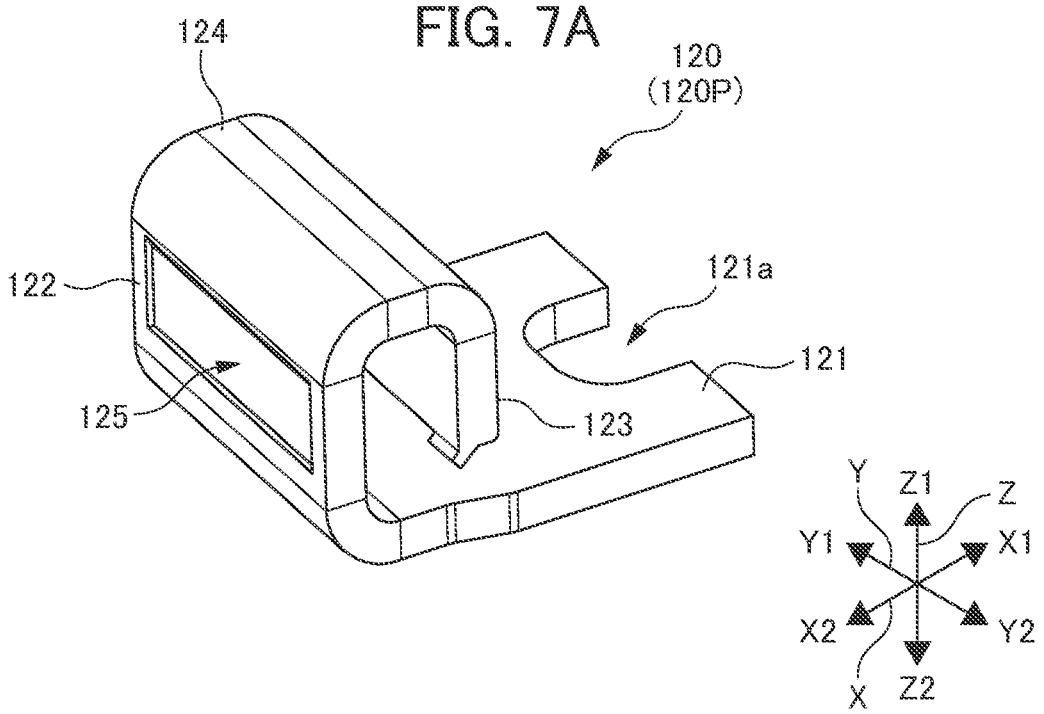
FIG. 7A is a perspective view of a power contact 120P according to one or more embodiments.
Figure 7B:
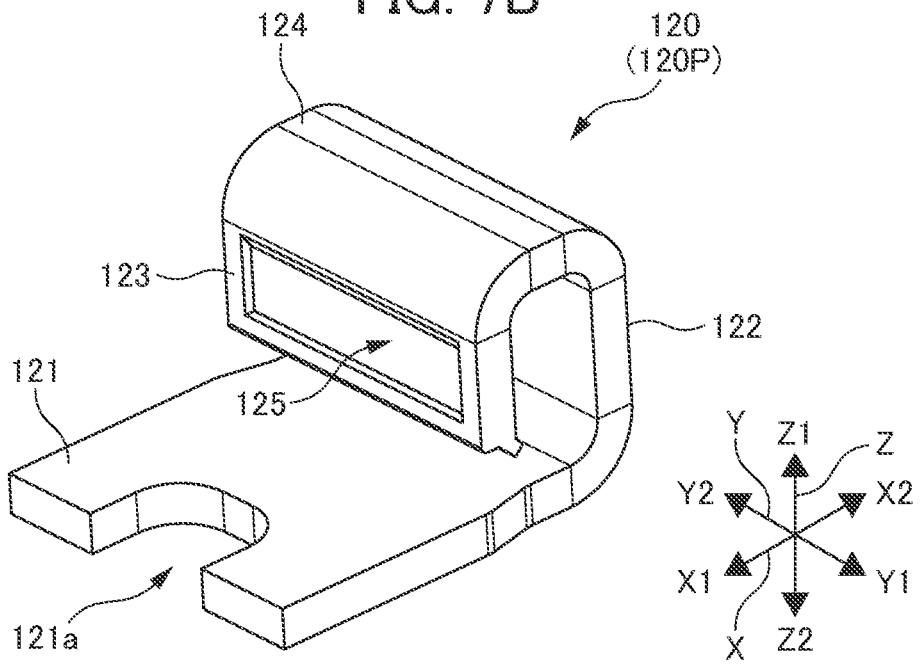
FIG. 7B is a perspective view of the power contact 120P.
Figure 8A:
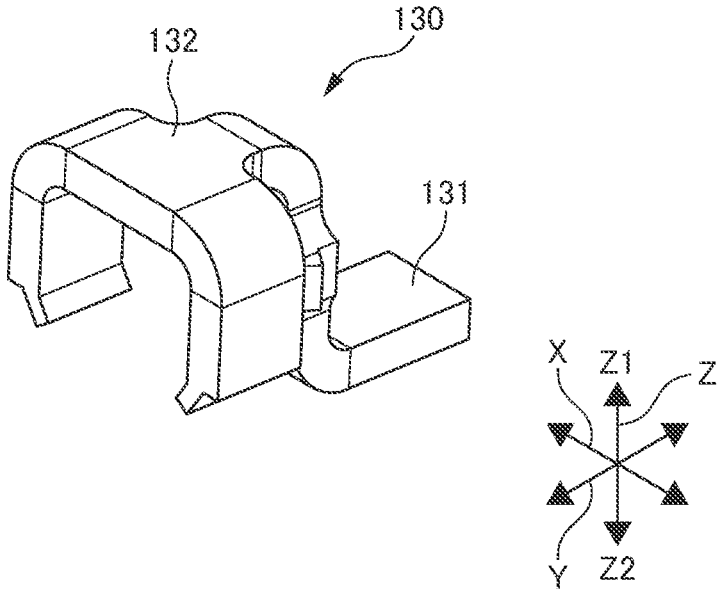
FIG. 8A is a perspective view of a plug fixture 130 according to one or more embodiments.
Figure 8B:
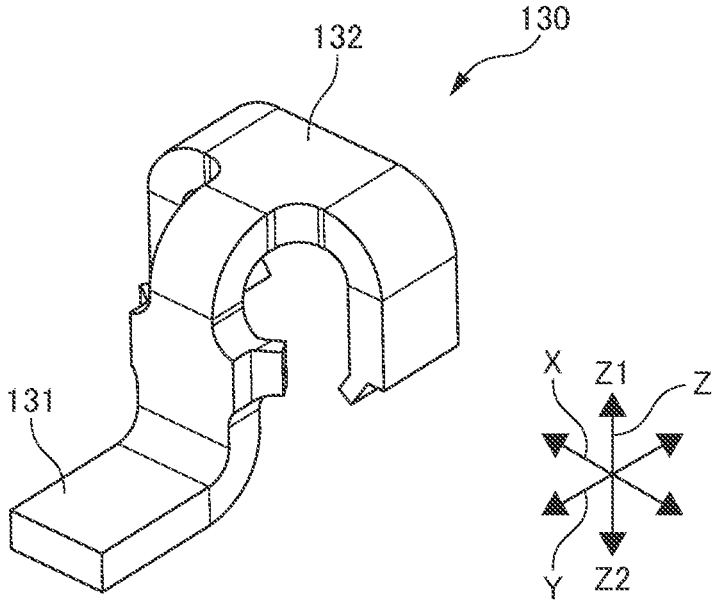
FIG. 8B is a perspective view of the plug fixture 130.

First, a description will be given the plug connector 10, which is one connector constituting the electric connector 1 of one or more embodiments. FIG. 1A is a perspective view of the plug connector 10. FIG. 2A is a perspective view of the plug connector 10 as viewed from a direction different from that of FIG. 1A. FIG. 3 is a perspective view of a board-to-board connector in a state of fitting the plug connector 10 to the receptacle connector 20. FIG. 4 is a plan view of the plug connector 10. FIG. 5A is a cross-sectional view taken along line A-A in FIG. 4. FIG. 5B is a cross-sectional view taken along line B-B in FIG. 4. FIGS. 6A and 6B are perspective views of a signal contact 120S. FIGS. 7A and 7B are perspective views of a power contact 120P. FIGS. 8A and 8B are perspective views of a plug fixture 130.

As shown in FIGS. 1A and 2A, the plug connector 10 includes a plug block (block) 100, plug contacts 120, and plug fixtures 130. The plug block 100 is a housing that holds the plug contacts 120, and is entirely formed in a substantially square prism shape. The plug block 100 includes a body 101 and a fitting portion 102. The body 101 is a base portion located on the side of the mounting face of the board (Z2 side), and is formed in a substantially plate shape. The fitting portion 102 protrudes toward the side (Z1 side) further away from the board than the body 101, and is inserted into the fitting port (recess 203) of the receptacle connector 20. In FIG. 2A, the fitting portion 102 is formed in a substantially U-shape in a cross section parallel to the X-Z plane.

The plug block 100 is mainly formed of a synthetic resin having electrical insulation properties. Examples of the material for the plug block 100 include liquid crystal polymers (LCPs), polyphenylene sulfide (PPS), polybutylene terephthalate (PBT), and polyamide (66PA, 46PA), but the material is not limited to these materials. The material for the plug block 100 may contain an inorganic filler, a reinforcing fiber, or the like. The plug block 100 has a shape that fits into the recess 203 (described later) in a housing 200 of the receptacle connector 20.

The plug contacts 120 includes signal contacts (contacts for signal) 120S and power contacts (contacts for power supply) 120P as electrode terminals. The configuration of the plug contacts 120 is not limited to this configuration, and the plug contacts 120 may include only signal contacts 120S. The plug contact 120 is made of an electrically conductive metal, and is formed by a known press working. Examples of the material for the plug contact 120 include copper, Corson copper such as copper alloys, beryllium copper, and phosphor bronze, but the material is not limited to these materials.

As shown in FIG. 4, three signal contacts 120S are provided. In addition, two power contacts 120P are provided. In the plug contacts 120, the signal contacts 120S and the power contacts 120P are arranged so as to be alternately arranged in one row along the longitudinal direction (Y direction) of the plug block 100 and so as to be symmetrical about a line L orthogonal to the center position C in the longitudinal direction, when viewed from the direction (Z direction) of fitting to the receptacle connector 20. In one or more embodiments, one signal contact 120S is arranged at the center position C in the longitudinal direction (Y direction) of the plug block 100, and two other signal contacts 120S and two power contacts 120P are arranged so as to be alternately arranged in one row along the longitudinal direction (Y direction) of the plug block 100 and so as to be symmetrical about the line L orthogonal to the center position C in the longitudinal direction. In FIG. 4, the direction of fitting to the receptacle connector 20 (Z direction) is a direction orthogonal to the X-Y plane.

In the plug contacts 120 of one or more embodiments, the total value $\Sigma W1$ of the width dimensions W1 of the signal contacts 120S is 0.6 to 0.8 mm. The total value $\Sigma W2$ of the width dimensions W2 of the power contacts 120P is 1.0 mm to 1.2 mm. Since a larger current flows through the power contact 120P than the signal contact 120S, the width dimension W2 of the power contact 120P is set to be wider than the width dimension W1 of the signal contact 120S. In one or more embodiments, the width dimension W2 of the power contact 120P is set to be about 0.4 mm to 0.6 mm larger than the width dimension W1 of the signal contact 120S. How much wider the width dimension W2 of the power contact 120P should be than the width dimension W1 of the signal contact 120S is appropriately set depending on the amount of current flowing or the like. When the width dimension of the plug contact 120 in the lateral direction is large, the unevenness in the lateral direction can be adjusted by adjusting the total value of the width dimensions of the signal contacts 120S and the total value of the width dimensions of the power contacts 120P.

As shown in FIGS. 5 to 7, the signal contact 120S and the power contact 120P each include a connection portion 121, a first contact portion 122, a second contact portion 123, and a coupling portion 124, and are formed so as to be substantially P-shaped as a whole in a side view in the Y direction. The connection portion 121 is a portion that is mounted on the board (not shown), and is formed in a substantially plate shape. As shown in FIGS. 7A and 7B, a concave end 121*a* having a substantially U-shape is formed in the connection portion 121 of the power contact 120P. By forming the concave end 121*a*, when the power contact 120P is mounted on the board, the soldering area (surface area) for connecting the connection portion 121 and the board is increased, and thus the connection strength can be improved. The side where the connection portion 121 of the signal contact 120S protrudes in the lateral direction (X direction) of the plug block 100 and the side where the connection portion 121 of the power contact 120P protrudes in the lateral direction of the plug block 100 are arranged in a staggered manner in the longitudinal direction (Y direction) of the plug block 100 (see FIG. 4).

The first contact portion 122 is extended at an end of the connection portion 121 and is formed so as to protrude in the Z1 direction. The second contact portion 123 is formed so as to protrude in the Z2 direction. The first contact portion 122 and the second contact portion 123 each contact the signal contact 220S or the power contact 220P when fitting to the receptacle connector 20. The coupling portion 124 has a U-shaped cross section, and couples the first contact portion 122 to the second contact portion 123.

In each of the first contact portion 122 and the second contact portion 123, a recess 125 is formed on the face on the side that makes contact with the receptacle connector 20. The recess 125 is a substantially rectangular recess formed in each of the contact portions. As will be described later, when the plug connector 10 is fitted to the receptacle connector 20, the first contact portion 224 and the second contact portion 223 of the receptacle contact 220 engage with the recesses 125 provided in the first contact portion 122 and the second contact portion 123 of the plug contact 120. The signal contacts 120S and the power contacts 120P are fixed to the plug block 100 by integral molding. Alternatively, the signal contacts 120S and the power contacts 120P may be fixed to the plug block 100 by insertion (press fitting) into and/or bonding (welding) to the plug block 100 after the plug block 100 is formed. The connection portion 121 of the signal contact 120S and the connection portion 121 of the power contact 120P are of surface mount (SMT) type. The mounting of the signal contact 120S and the power contact 120P is not limited, and may be performed by, for example, a dip type method or a press fit method.

The plug fixtures 130 will be described. As shown in FIG. 4, the plug fixtures 130 are disposed at both ends of the plug block 100 in the longitudinal direction (Y direction). The plug fixture 130 is made of an electrically conductive metal, and is formed by a known press working. Examples of the material for the plug fixture 130 include copper, Corson copper such as copper alloys, beryllium copper, and phosphor bronze, but the material is not limited to these materials. The plug fixture 130 is made by a known press working. As shown in FIGS. 1A, 2A, etc., both ends of the plug block 100 in the longitudinal direction (Y direction) are partially covered with the plug fixtures 130 so as to reinforce both ends of the plug block 100 in the longitudinal direction. The plug fixtures 130 also function as fixing brackets (fixing tabs) for fixing the plug block 100 to the board.

The plug fixtures 130 are integrated during injection molding of the plug block 100. That is, the plug fixture 130 is held (set) in a mold (not shown) as an insert body, and a synthetic resin material of the plug block 100 is injected (filled) into the space forming the wall thickness of the plug block 100, so that the plug fixture 130 is fixed (held) to the plug block 100. Alternatively, the plug fixture 130 may be fixed to the plug block 100 by insertion (press fitting) into and/or bonding (welding) to the plug block 100 after the plug block 100 is formed.

In FIGS. 8A and 8B, the plug fixture 130 is shown on its own. As shown in FIGS. 8A and 8B, the plug fixture 130 includes a connection portion 131 and a body 132. The connection portion 131 is a portion that is mounted on the board (not shown), and is formed so as to be substantially L-shaped when viewed from the X direction. When the plug fixtures 130 are fixed to the plug block 100, the connection portions 131 of the plug fixtures 130 protrude on both sides of the plug block 100 in the longitudinal direction (see FIG. 4). The body 132 is formed so that the central part in the X direction is extended to an end of the connection portion 131 on the Z1 side, and is formed so as to be substantially U-shaped when viewed from the Y direction. The plug fixtures 130 of one or more embodiments are of the SMT type. The mounting of the plug fixture 130 is not limited, and may be performed by, for example, a dip type method or a press fit method.

(Receptacle Connector 20)

Figure 9:
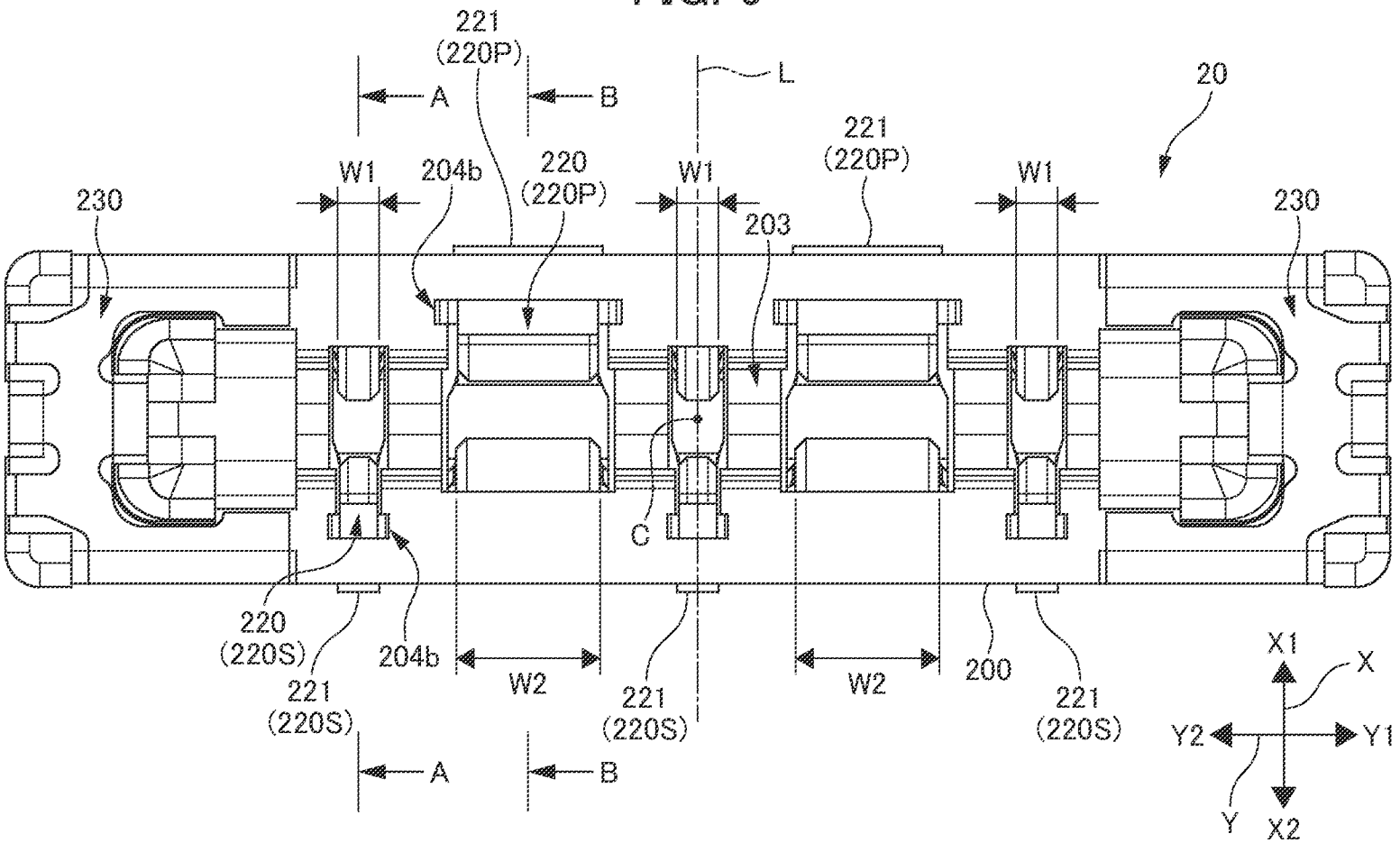
FIG. 9 is a plan view of the receptacle connector 20.
Figure 10A:
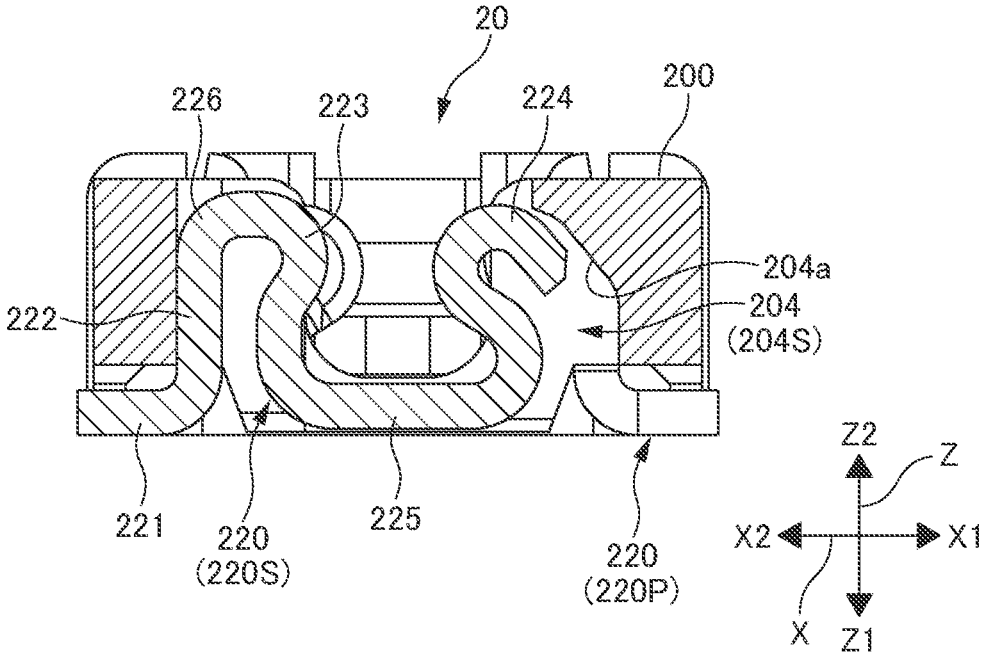
FIG. 10A is a cross-sectional view taken along line A-A in FIG. 9.
Figure 10B:
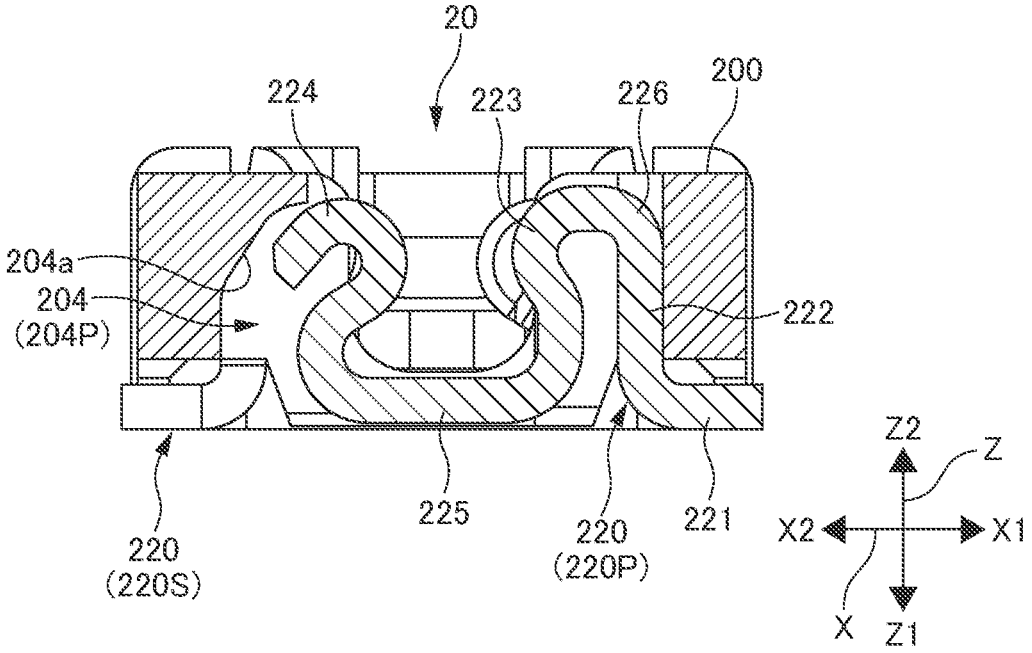
FIG. 10B is a cross-sectional view taken along line B-B in FIG. 9.
Figure 11A:
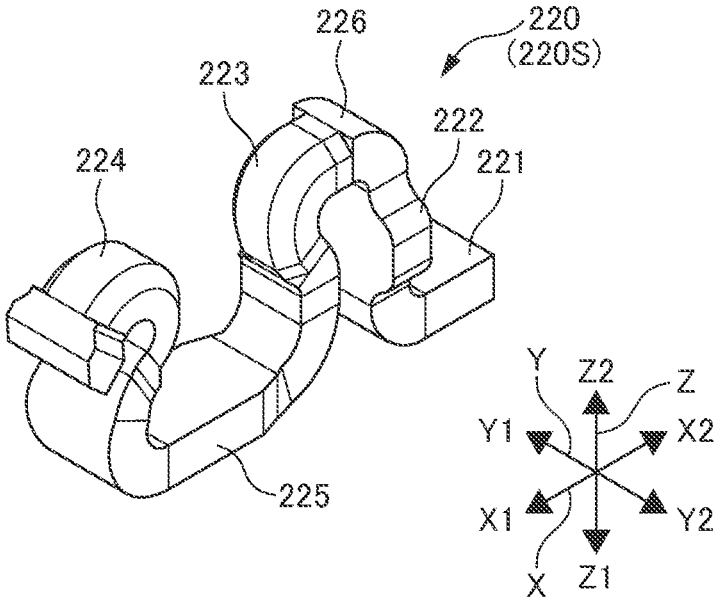
FIG. 11A is a perspective view of a signal contact 220S according to one or more embodiments.
Figure 11B:
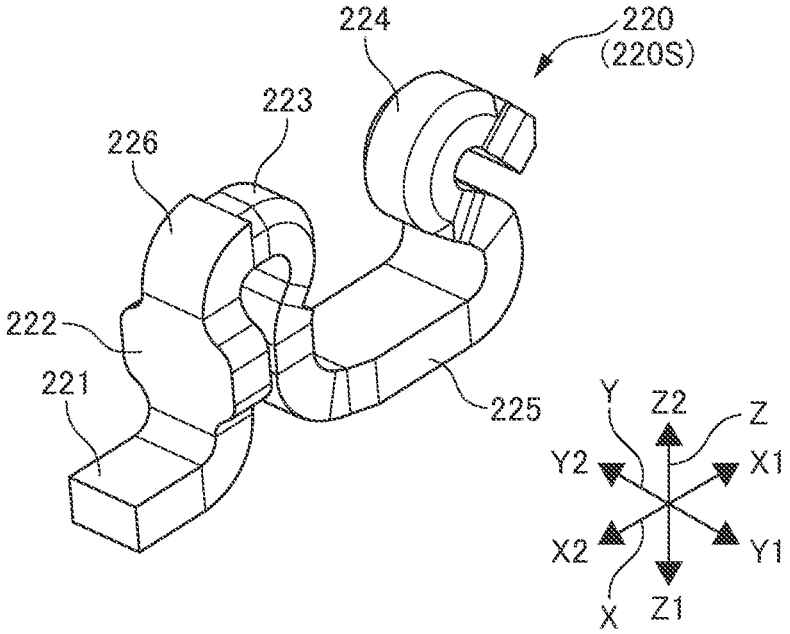
FIG. 11B is a perspective view of the signal contact 220S.
Figure 12A:
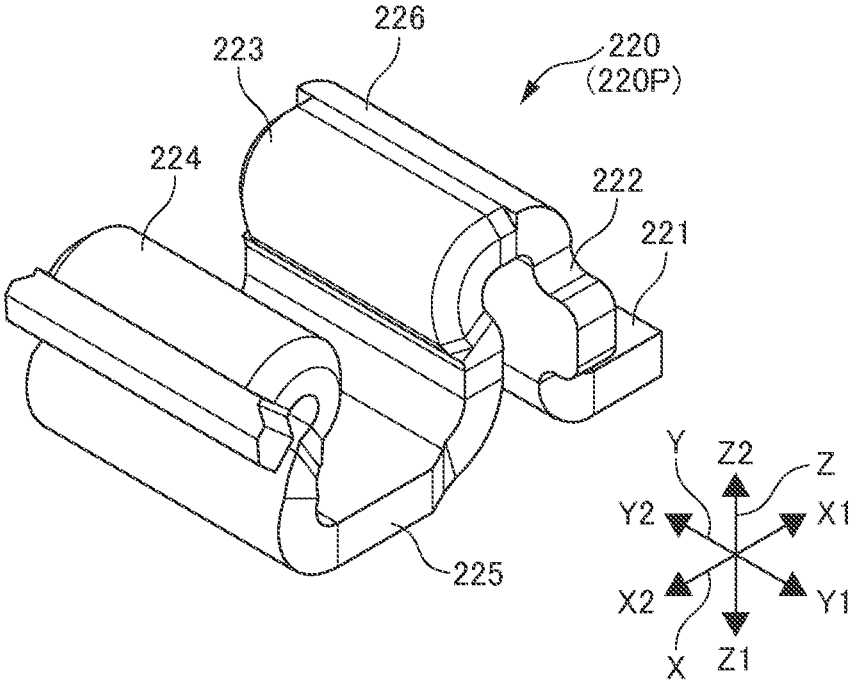
FIG. 12A is a perspective view of a power contact 220P according to one or more embodiments.
Figure 12B:
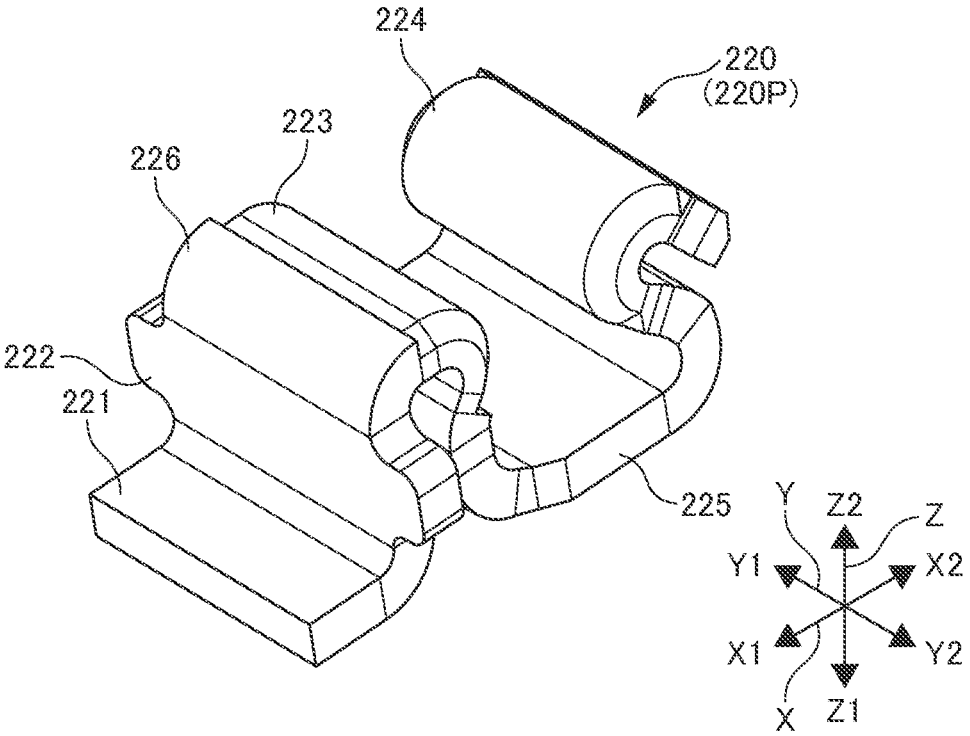
FIG. 12B is a perspective view of the power contact 220P.
Figure 13A:
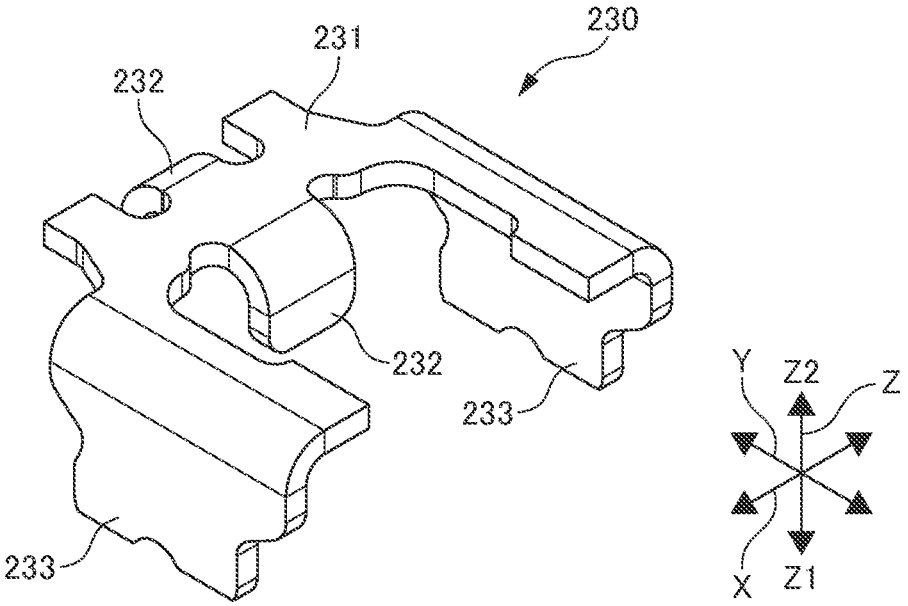
FIG. 13A is a perspective view of a receptacle fixture 230 according to one or more embodiments.
Figure 13B:
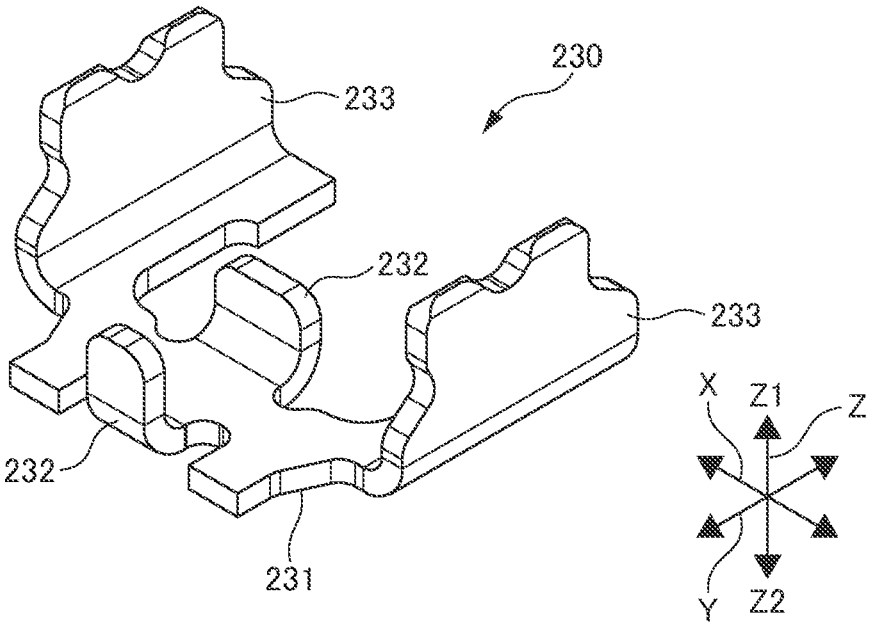
FIG. 13B is a perspective view of the receptacle fixture 230.

Next, a description will be given of the receptacle connector 20, which is the other connector constituting the electric connector 1 of one or more embodiments. FIG. 1B is a perspective view of the receptacle connector 20. FIG. 2B is a perspective view of the receptacle connector 20 as viewed from a direction different from that of FIG. 1B. FIG. 9 is a plan view of the receptacle connector 20. FIG. 10A is a cross-sectional view taken along line A-A in FIG. 9. FIG. 10B is a cross-sectional view taken along line B-B in FIG. 9. FIGS. 11A and 11B are perspective views of the signal contact 220S. FIGS. 12A and 12B are perspective views of the power contact 220P. FIGS. 13A and 13B are perspective views of a receptacle fixture 230.

As shown in FIGS. 1B and 2B, the receptacle connector 20 includes a housing 200, receptacle contacts 220, and receptacle fixtures 230. The housing 200 is manufactured by injection molding or the like by using an electrically insulating synthetic resin as a material. The synthetic resin material is appropriately selected in consideration of dimensional stability, workability, cost, and the like. Examples of the material include liquid crystal polymers (LCPs), polyphenylene sulfide (PPS), polybutylene terephthalate (PBT), polyamide (PA), and polycarbonate (PC), but the material is not limited to these materials. The material for the housing 200 may contain an inorganic filler, a reinforcing fiber, or the like.

The housing 200 holds the receptacle contacts 220, and is formed in a flat and substantially rectangular parallelepiped shape. As shown in FIG. 1B, a recess 203 is formed in the housing 200. The recess 203 is a fitting port having a size for inserting the fitting portion 102 (see FIG. 1A) of the plug connector 10. Specifically, as shown in FIG. 1B, the housing 200 includes a bottom wall 201 and a peripheral wall 202 that stands from the periphery of the bottom wall 201 in the Z2 direction. The bottom wall 201 and the peripheral wall 202 define the recess 203. The recess 203 opens to a side (Z2 side) opposite to the mounting face of the board, and receives the plug connector 10. The size of the recess 203 may be any size as long as the recess can receive the plug connector 10, and is appropriately designed in consideration of connection stability, dimensional stability, workability, and the like. The peripheral wall 202 includes two side walls 202*a* and 202*a* (only the side wall on the X1 side is shown in the FIG. 1B) located on both sides in the lateral direction (X direction) and two coupling walls 202*b* and 202*b* (only the coupling wall on the Y1 side is shown in FIG. 1B) located on both sides in the longitudinal direction (Y direction). The two side walls 202*a* and 202*a* extend in the longitudinal direction (Y direction) of the housing 200 and face each other in the lateral direction (X direction). The two coupling walls 202*b* and 202*b* couple the two side walls 202*a* and 202*a* at both ends of the housing 200 in the longitudinal direction.

The receptacle contacts 220 held by the housing 200 include signal contacts (contacts for signal) 220S and power contacts (contacts for power supply) 220P as electrode terminals. The receptacle contact 220 is made of an electrically conductive metal, and is formed by a known press working. Examples of the material for the receptacle contact 220 include copper, Corson copper such as copper alloys, beryllium copper, and phosphor bronze, but the material is not limited to these materials.

As shown in FIGS. 10A and 10B, inside the side wall 202*a*, an insertion portion 204S of the signal contact (contact for signal) 220S and an insertion portion 204P of the power contact (contact for power supply) 220P are formed. The insertion portions 204S and 204P (hereinafter, also referred to as "insertion portions 204") penetrate in the height direction of the housing 200 (Z direction). The insertion portion 204 is provided with an inclined face 204*a*. The inclined face 204*a* is formed so that, when the receptacle connector 20 is fitted to the plug connector 10, the signal contact 220S or the power contact 220P pressed by the plug contact 120 do not deform unnecessarily. By forming the inclined face 204*a* in the insertion portion 204, it is possible to obtain a stable contact pressure of the receptacle contact 220 against the plug contact 120. As shown in FIG. 9, an engagement groove 204*b* is formed in the insertion portion 204. The engagement groove 204*b* is a groove-shaped recess that engages with a holding portion 222 (described later) of the signal contact 220S or the power contact 220P.

When the receptacle contact 220 is assembled into the insertion portion 204 by insertion (press fitting), the insertion portion 204 may be formed so as to be dimensioned to be pressed against the receptacle contact 220 as a whole. Alternatively, the receptacle contact 220 can be integrated during injection molding of the housing 200. That is, each receptacle contact 220 may be held (set) in a mold (not shown) as an insert body, and an electrically insulating synthetic resin material that forms the housing 200 may be injected (filled) into the space that forms the wall thickness of the housing 200, so that the receptacle contact 220 may be fixed (held) to the housing 200. The receptacle contact 220 may be held in any manner as long as the receptacle contact 220 can be held, and may be hooked, welded, or integrally molded. The holding mode is appropriately designed in consideration of connection stability, holding strength, workability, and the like.

As shown in FIG. 9, the receptacle contacts 220 include three signal contacts 220S. The receptacle contacts 220 also include two power contacts 220P. The signal contacts 220S and the power contacts 220P are arranged so as to be alternately arranged in one row along the longitudinal direction (Y direction) of the housing 200 and so as to be symmetrical about a line L orthogonal to the center position C in the longitudinal direction, when viewed from the direction (Z direction) of fitting to the plug connector 10. In FIG. 9, the direction of fitting to the plug connector 10 (Z direction) is a direction orthogonal to the X-Y plane.

In the receptacle contacts 220 of one or more embodiments, the total value ΣW1 of the width dimensions W1 of the signal contacts 220S is 0.3 to 0.5 mm. The total value ΣW2 of the width dimensions W2 of the power contacts 220P is 0.8 mm to 1.0 mm. Since a larger current flows through the power contact 220P than the signal contact 220S, the width dimension W2 of the power contact 220P is set to be wider than the width dimension W1 of the signal contact 220S. In one or more embodiments, the width dimension W2 of the power contact 220P is set to be about 0.5 mm to 0.7 mm larger than the width dimension W1 of the signal contact 220S. How much wider the width dimension W2 of the power contact 220P should be than the width dimension W1 of the signal contact 220S is appropriately set depending on the amount of current flowing or the like. When the width dimension of the receptacle contact 220 in the lateral direction is large, the unevenness in the lateral direction can be adjusted by adjusting the total value of the width dimensions of the signal contacts 220S and the total value of the width dimensions of the power contacts 220P.

As shown in FIGS. 10 to 12, the signal contact 220S and the power contact 220P each include a connection portion 221, a holding portion 222, a second contact portion 223, a first contact portion 224, a coupling portion 225, and an elastic portion 226. The connection portion 221 is a portion that is mounted on the board (not shown), and is formed in a substantially plate shape. The side where the connection portion 221 of the signal contact 220S protrudes in the lateral direction (X direction) of the housing 200 and the side where the connection portion 221 of the power contact 220P protrudes in the lateral direction of the housing 200 are arranged in a staggered manner in the longitudinal direction (Y direction) of the housing 200 (see FIG. 9).

The holding portion 222 is extended to the end of the connection portion 221 and is formed so as to protrude toward the Z2 direction. The holding portion 222 is a portion that engages with the insertion portion 204S or 204P (engagement groove 204*b*) of the housing 200, and protrudes on both sides in the Y direction as shown in FIGS. 11 and 12. The second contact portion 223 is convexly curved inward in the X direction (the side of the first contact portion 224). The first contact portion 224 faces the second contact portion 223, and is convexly curved inward in the X direction (the side of the second contact portion 223). The first contact portion 224 and the second contact portion 223 each have a curved shape and both sides in the width direction (Y direction) are chamfered, so as to be easily contacted with the signal contact 120S or the power contact 120P of the plug connector 10 when fitting to the plug connector 10.

The coupling portion 225 has a substantially U-shape in a side view in the Y direction, and couples the first contact portion 224 to the second contact portion 223. The elastic portion 226 is a curved part provided between the connection portion 221 and the second contact portion 223. The elastic portion 226 is deformed by being pushed by the plug contact 120 when fitting to the plug connector 10. This facilitates insertion of the plug contact 120, and provides a stable connection (contact) with the inserted plug contact 120. The structure of the receptacle contact 220 is not limited to the illustrated example as long as the receptacle contact 220 can make contact with the plug contact 120 of the plug connector 10. The signal contacts 220S and the power contacts 220P are fixed to the housing 200 by insertion (press fitting). Alternatively, the signal contacts 220S and the power contacts 220P may be integrally molded with the housing 200 at the same time as the housing 200 is formed, and/or may be fixed to the housing 200 by bonding (welding) after the housing 200 is formed. The connection portion 221 of the signal contact 220S and the connection portion 221 of the power contact 220P are of the SMT type. The mounting of the signal contact 220S and the power contact 220P is not limited, and may be performed by, for example, a dip type method or a press fit method.

The receptacle fixtures 230 will be described. As shown in FIGS. 1B, 2B, etc., the receptacle fixtures 230 are disposed at both ends of the housing 200 in the longitudinal direction (Y direction). The receptacle fixture 230 is made of an electrically conductive metal, and is formed by a known press working. Examples of the material for the receptacle fixture 230 include copper, Corson copper such as copper alloys, beryllium copper, and phosphor bronze, but the material is not limited to these materials. The receptacle fixture 230 is made by a known press working. As shown in FIGS. 1B, 2B, etc., both ends of the housing 200 in the longitudinal direction (Y direction) are partially covered with the receptacle fixtures 230 so as to reinforce both ends of the housing 200 in the longitudinal direction. The receptacle fixtures 230 also function as fixing brackets (fixing tabs) for fixing the housing 200 to the board.

The receptacle fixture 230 is integrated during injection molding of the housing 200. That is, the receptacle fixture 230 is held (set) in a mold (not shown) as an insert body, and a synthetic resin material of the housing 200 is injected (filled) into the space forming the wall thickness of the housing 200, so that the receptacle fixture 230 is fixed (held) to the housing 200. Alternatively, the receptacle fixture 230 may be fixed to the housing 200 by insertion (press fitting) into and/or bonding (welding) to the housing 200 after the housing 200 is formed.

In FIGS. 13A and 13B, the receptacle fixture 230 is shown on its own. As shown in FIGS. 13A and 13B, the receptacle fixture 230 includes a body 231, protruding pieces 232, and connection portions 233. The body 231 is substantially C-shaped when viewed the receptacle fixture 230 from the Z2 direction. The protruding pieces 232 protrude toward the board side (Z1 side) from both ends in the Y direction in a substantially central part of the body 231 in the X direction. The connection portions 233 protrude from both ends of the body 231 in the X direction toward the board side (Z1 side). When the receptacle fixture 230 is fixed to the housing 200, the connection portions 233 are located on both sides of the housing 200 in the lateral direction (X direction). Therefore, when the receptacle fixture 230 is fixed to the housing 200, the inside and outside of the coupling wall 202*b* (see FIG. 1B) of the housing 200 are sandwiched between the two connection portions 233. The receptacle fixtures 230 of one or more embodiments are of the SMT type. The mounting of the receptacle fixture 230 is not limited, and may be performed by, for example, a dip type method or a press fit method.

Figure 14:
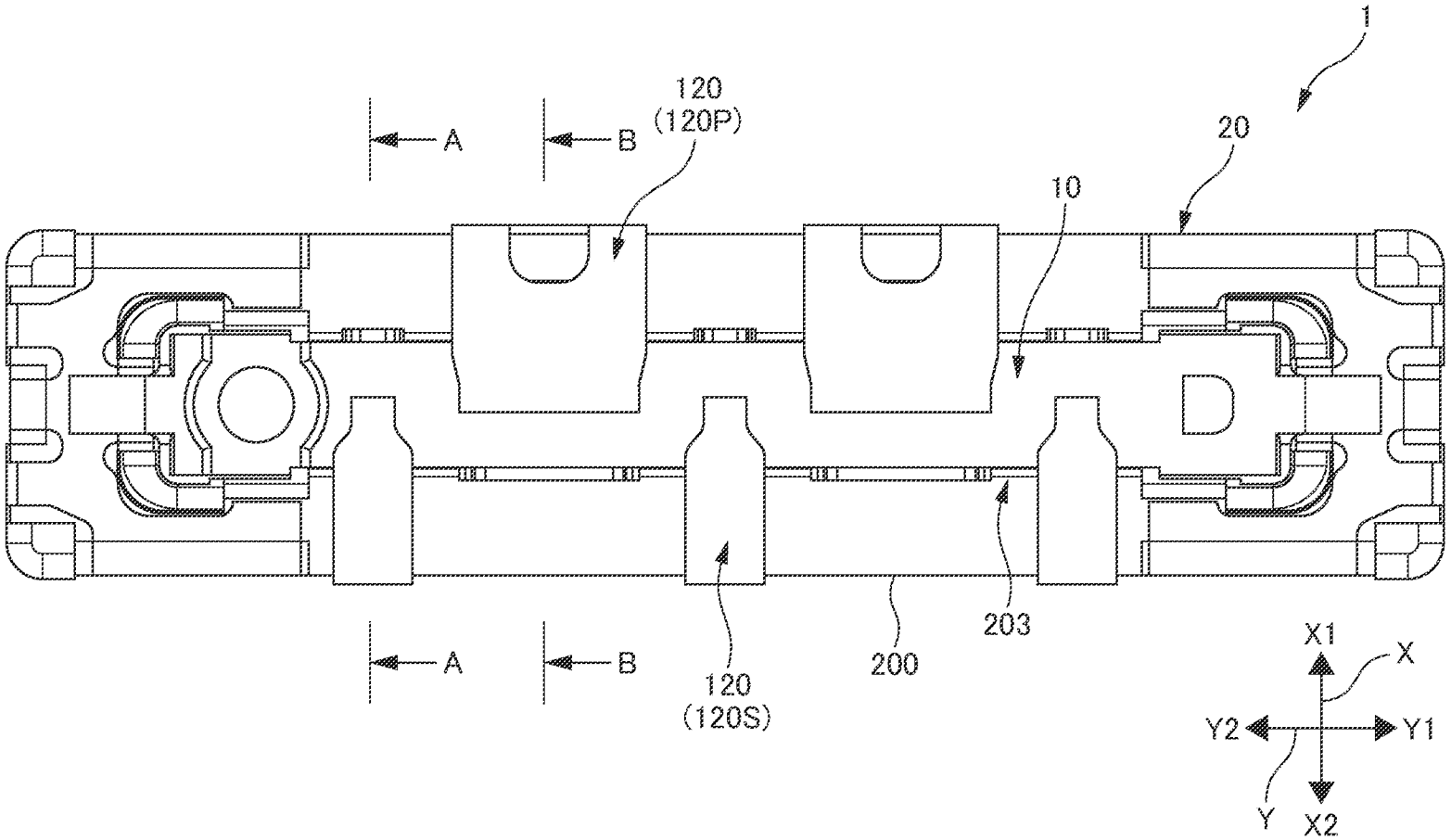
FIG. 14 is a plan view of the board-to-board connector in FIG. 3.
Figure 15A:
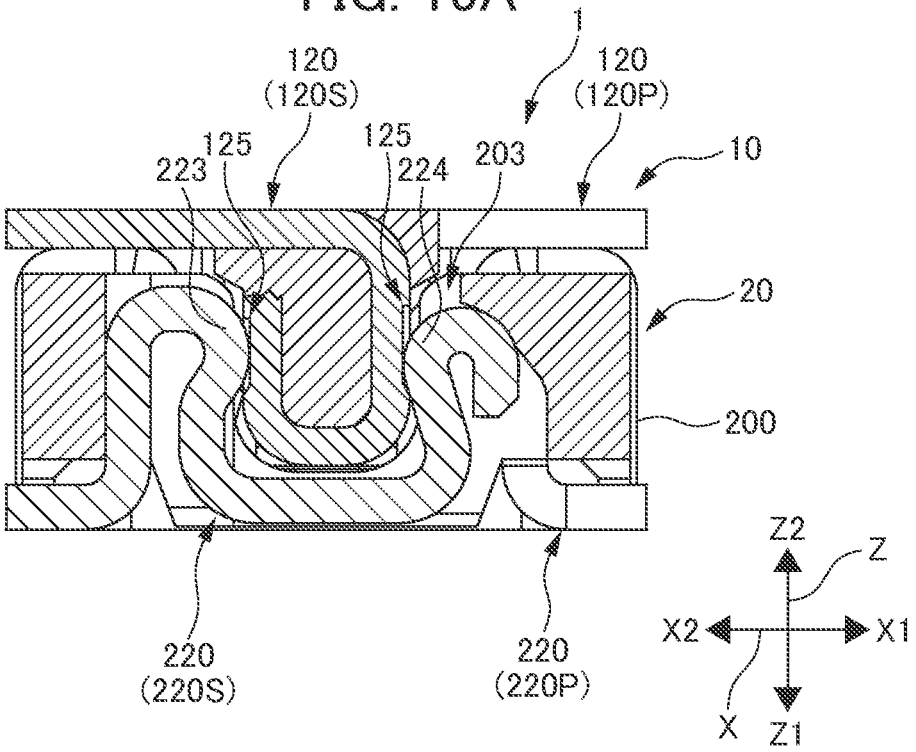
FIG. 15A is a cross-sectional view taken along line A-A in FIG. 14.
Figure 15B:
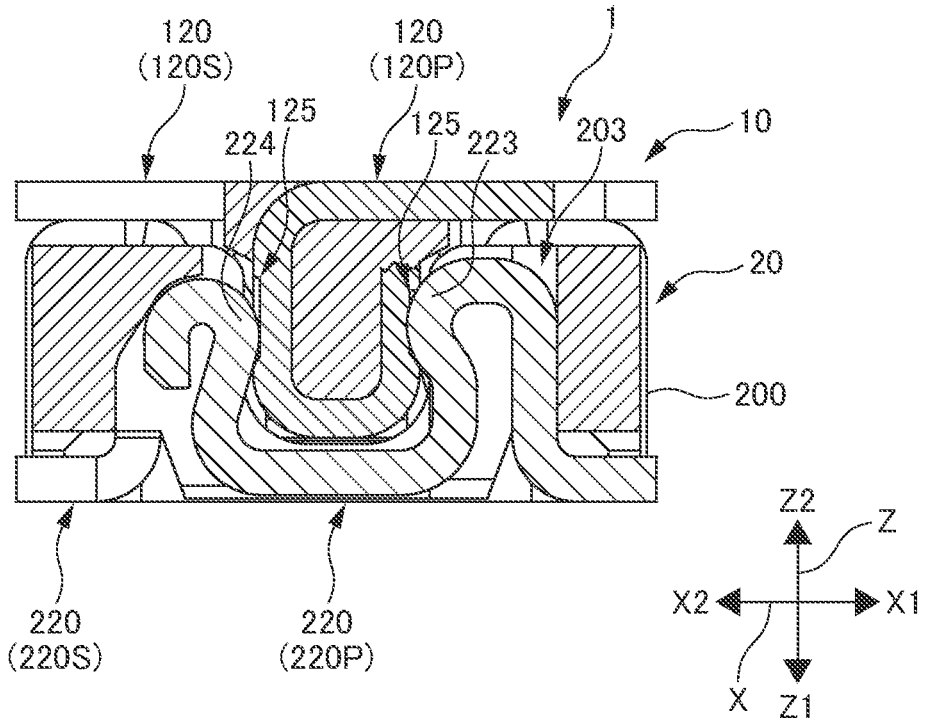
FIG. 15B is a cross-sectional view taken along line B-B in FIG. 14.

A description will be given of a fitting state of the plug connector 10 and the receptacle connector 20. FIG. 14 is a plan view of the board-to-board connector in FIG. 3. FIG. 15A is a cross-sectional view taken along line A-A in FIG. 14. FIG. 15B is a cross-sectional view taken along line B-B in FIG. 14. As shown in FIGS. 3 and 14 to 15B, the plug connector 10 is inserted into the recess 203 (housing 200) of the receptacle connector 20, so that both connectors are fitted to each other. In this fitting state, as shown in FIG. 15A, the plug contact 120 (signal contact 120S) of the plug connector 10 is in contact with the receptacle contact 220 (signal contact 220S) of the receptacle connector 20 at two locations. In this way, the signal contact of the plug connector 10 and the signal contact of the receptacle connector 20 make contact with each other, so that signals can be transmitted and received between the boards on which the respective connectors are mounted. As shown in FIG. 15A, when the plug connector 10 and the receptacle connector 20 are fitted to each other, the first contact portion 224 and the second contact portion 223 of the signal contact 220S (receptacle contact 220) engage with the recesses 125 provided in the first contact portion 122 and the second contact portion 123 of the signal contact 120S (plug contact 120).

As shown in FIG. 15B, the plug contact 120 (power contact 120P) of the plug connector 10 contacts the receptacle contact 220 (power contact 220P) of the receptacle connector 20 at two locations. In this way, the power contact of the plug connector 10 and the power contact of the receptacle connector 20 make contact with each other, so that power can be supplied from the board with one connector mounted to the board with the other connector mounted. As shown in FIG. 15B, when the plug connector 10 and the receptacle connector 20 are fitted to each other, the first contact portion 224 and the second contact portion 223 of the power contact 220P (receptacle contact 220) engage with the recesses 125 provided in the first contact portion 122 and the second contact portion 123 of the power contact 120P (plug contact 120).

According to the plug connector 10, the receptacle connector 20, and the electric connector 1 of the embodiments described above, for example, the following effects are obtained. The plug contacts 120 (signal contacts 120S and power contacts 120P) of the plug connector 10 are arranged so as to be alternately arranged in one row along the longitudinal direction (Y direction) of the plug block 100 and so as to be symmetrical about the line L orthogonal to the center position C in the longitudinal direction (see FIG. 4), when viewed from the direction (Z direction) of fitting to the receptacle connector 20. Therefore, in the plug connector 10, the insertion and extraction forces between the center position C in the longitudinal direction of the plug block 100 and the end in the Y1 direction and those between the center position C and the end in the Y2 direction are substantially equal.

The receptacle contacts 220 (signal contacts 220S and power contacts 220P) of the receptacle connector 20 are arranged so as to be alternately arranged in one row along the longitudinal direction (Y direction) of the housing 200 and so as to be symmetrical about the line L orthogonal to the center position C in the longitudinal direction, when viewed from the direction (Z direction) of fitting to the plug connector 10 (see FIG. 9). Therefore, in the receptacle connector 20, the insertion and extraction forces between the center position C in the longitudinal direction of the housing 200 and the end in the Y1 direction and those between the center position C and the end in the Y2 direction are substantially equal. Therefore, the plug connector 10, the receptacle connector 20, and the electric connector 1 of one or more embodiments can reduce the unevenness of insertion and extraction forces in the arrangement direction of the contacts.

In the plug contacts 120 (plug connector 10), the sides where the connection portions 121 of the signal contacts 120S protrude in the lateral direction (X direction) of the plug block 100 and the sides where the connection portions 121 of the power contacts 120P protrude in the lateral direction of the plug block 100 are arranged in a staggered manner in the longitudinal direction (Y direction) of the plug block 100. Further, in the receptacle contacts 220 (receptacle connector 20), the sides where the connection portions 221 of the signal contacts 220S protrude in the lateral direction (X direction) of the housing 200 and the sides where the connection portions 221 of the power contacts 220P protrude in the lateral direction of the housing 200 are arranged in a staggered manner in the longitudinal direction (Y direction) of the housing 200. Therefore, the balance of the mounting strength between the plug contacts 120 and the board and the balance of the mounting strength between the receptacle contacts 220 and the board can be more equalized.

The connection portions 131 of the plug fixtures 130 fixed to the plug block 100 (plug connector 10) protrude on both sides of the plug block 100 in the longitudinal direction (Y direction). Therefore, it is possible to increase the fixing strength at both ends of the plug block 100 mounted on the board in the longitudinal direction. Further, the connection portions 233 of the receptacle fixtures 230 fixed to the housing 200 (receptacle connector 20) are located on both sides of the housing 200 in the lateral direction (X direction). Therefore, when the receptacle fixture 230 is fixed to the housing 200, the inside and outside of the coupling wall 202*b* (see FIG. 1B) of the housing 200 are sandwiched between the two connection portions 233. Therefore, it is possible to increase the fixing strength at both ends in the longitudinal direction and in the lateral direction of the housing 200 mounted on the board.

In each of the first contact portion 122 and the second contact portion 123 of the plug contact 120, the recess 125 is formed on the face on the side that makes contact with the receptacle connector 20. Thus, when the plug connector 10 and the receptacle connector 20 are fitted to each other, the first contact portion 224 and the second contact portion 223 of the receptacle contact 220 engage with the recesses 125 provided in the first contact portion 122 and the second contact portion 123 of the plug contact 120. Therefore, it is possible to bring the plug connector 10 into contact with the receptacle connector 20 in a more stable state.

(Modification)

Figure 16:
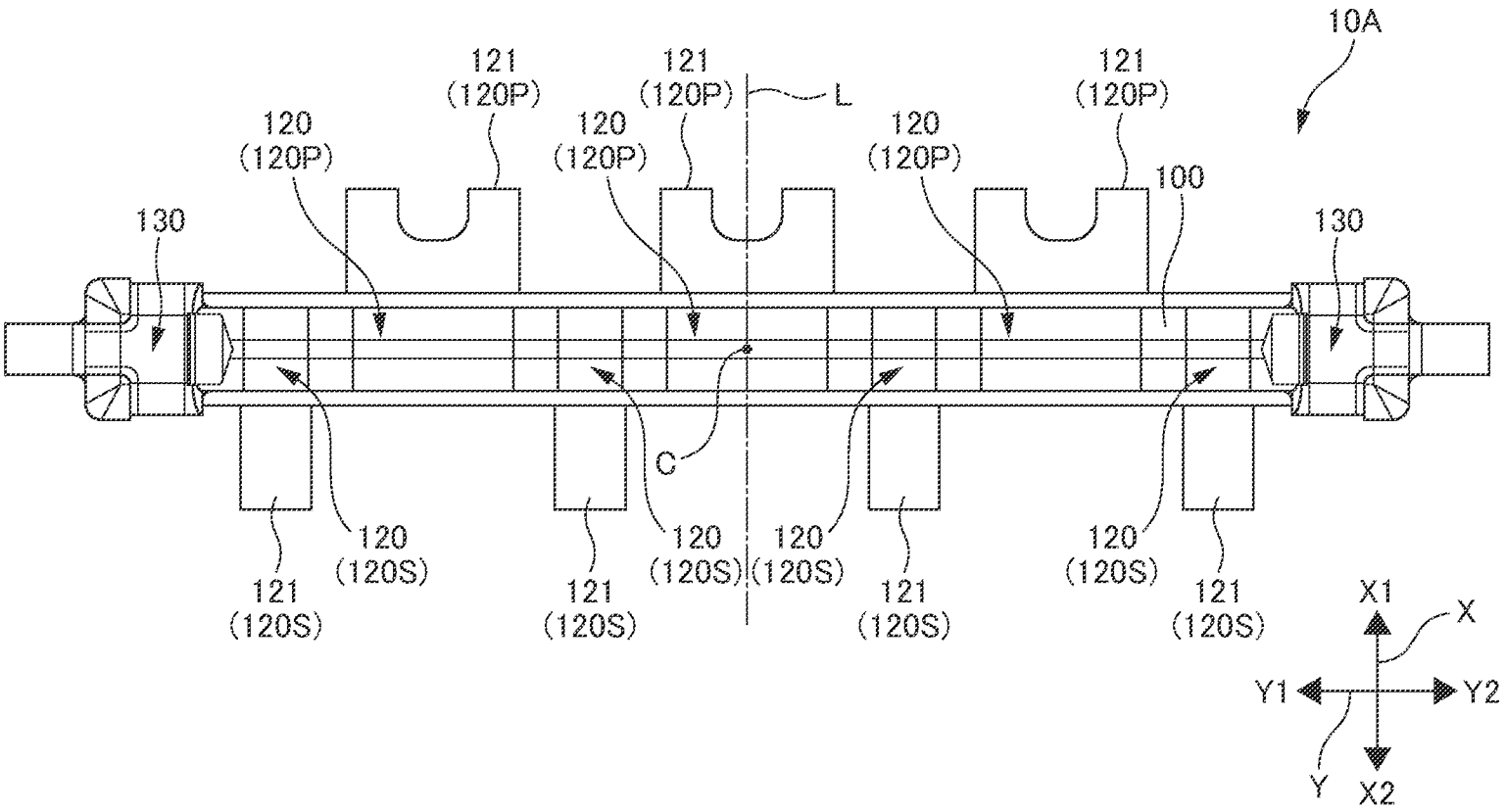
FIG. 16 is a plan view of a plug connector 10A according to one or more embodiments.
Figure 17:
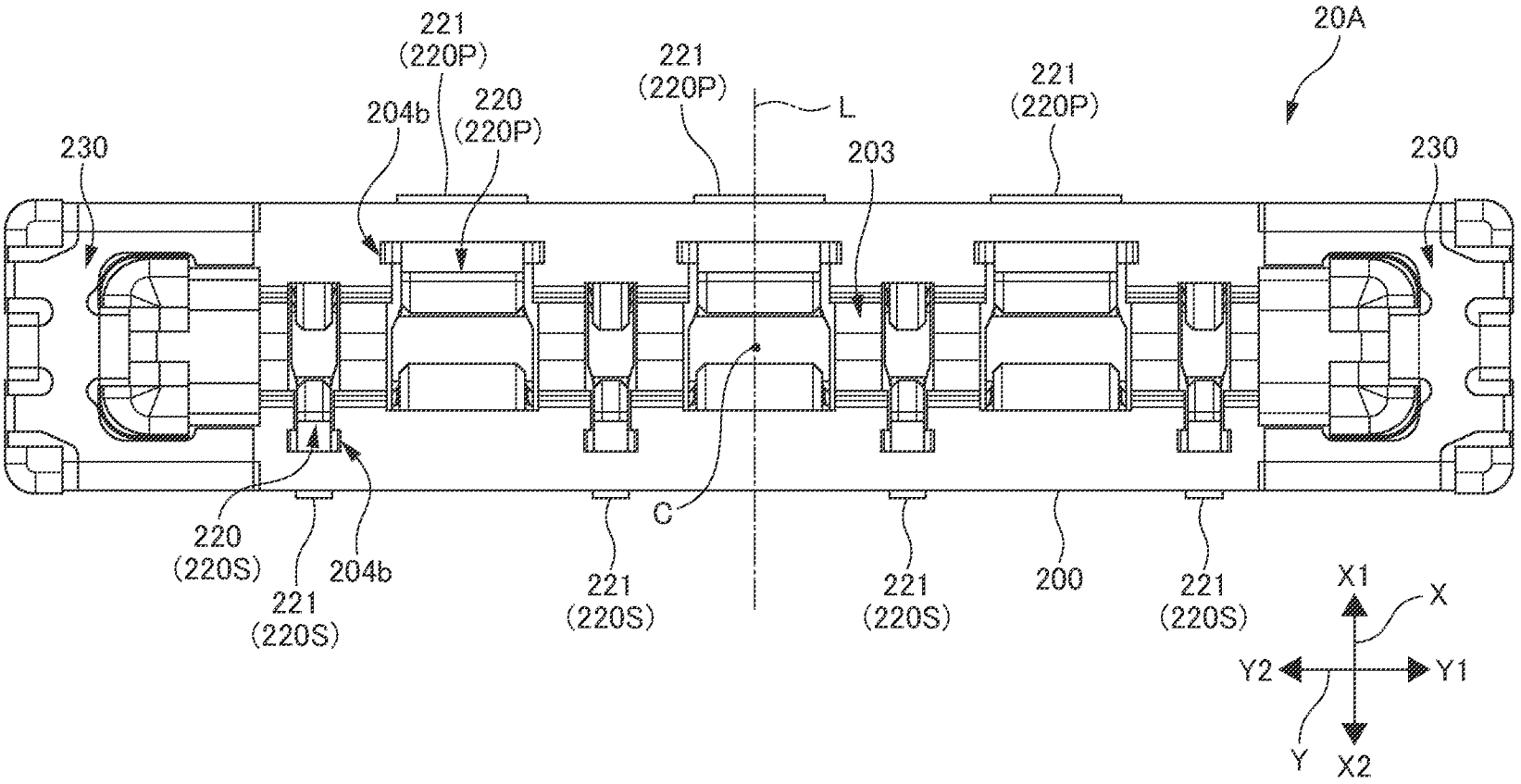
FIG. 17 is a plan view of a receptacle connector 20A.

FIG. 16 is a plan view of a plug connector 10A in a modification. FIG. 17 is a plan view of a receptacle connector 20A in the modification. The numbers of the signal contacts 120S and the power contacts 120P of the plug connector 10A of the modification differ from those of the embodiments described above. Similarly, the numbers of the signal contacts 220S and the power contacts 220P of the receptacle connector 20A of the modification differ from those of the embodiments described above. In the plug connector 10A and the receptacle connector 20A of the modification, other configurations are the same as in the embodiments described above. Therefore, in the description and the drawings of the modification, components and the like equivalent to those of the embodiments described above are denoted by the same reference numerals as those of the embodiments described above, and overlapping descriptions are omitted.

As shown in FIG. 16, in the plug connector 10A of the modification, four signal contacts 120S are provided. In addition, three power contacts 120P are provided. In the plug contacts 120 of the modification, the signal contacts 120S and the power contacts 120P are arranged so as to be alternately arranged in one row along the longitudinal direction (Y direction) of the plug block 100 and so as to be symmetrical about the line L orthogonal to the center position C in the longitudinal direction, when viewed from the direction (Z direction) of fitting to the receptacle connector 20A. In the modification, one of the power contacts 120P is arranged at the center position C in the longitudinal direction (Y direction) of the plug block 100, and the other two power contacts 120P and the four signal contacts 120S are arranged so as to be alternately arranged in one row along the longitudinal direction (Y direction) of the plug block 100 and so as to be symmetrical about the line L orthogonal to the center position C in the longitudinal direction. In FIG. 16, the direction (Z direction) of fitting to the receptacle connector 20A is a direction orthogonal to the X-Y plane.

As shown in FIG. 17, in the receptacle connector 20A of the modification, four signal contacts 220S are provided. In addition, three power contacts 220P are provided. The signal contacts 120S and the power contacts 120P are arranged so as to be alternately arranged in one row along the longitudinal direction (Y direction) of the housing 200 and so as to be symmetrical about the line L orthogonal to the center position C in the longitudinal direction, when viewed from the direction (Z direction) of fitting to the plug connector 10. In the modification, one of the power contacts 220P is arranged at the center position C in the longitudinal direction (Y direction) of the housing 200, and the other two power contacts 220P and the four signal contacts 220S are arranged so as to be alternately arranged in one row along the longitudinal direction (Y direction) of the housing 200 and so as to be symmetrical about the line L orthogonal to the center position C in the longitudinal direction. In FIG. 17, the direction (Z direction) of fitting to the plug connector 10A is a direction orthogonal to the X-Y plane. As in the above-described modification, in the plug connector 10A and the receptacle connector 20A, even in the configuration in which four signal contacts and three power contacts are provided, it is possible to reduce the unevenness of insertion and extraction forces in the arrangement direction of the contacts similarly to the embodiments described above.

In the above embodiments and modifications, the plug connectors 10 and 10A and the receptacle connectors 20 and 20A each mounted perpendicularly on the board have been described, but the direction in which each connector is mounted on the board is not limited to this direction. For example, each connector may be mounted parallel to the board as long as the signal contacts 120S and 220S and the power contacts 120P and 220P are arranged so as to be alternately arranged in one row along the arrangement direction and so as to be symmetrical about a line orthogonal to the center position in the arrangement direction, when viewed from the direction of fitting to each connector.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 electric connector
10, 10A plug connector
20, 20A receptacle connector
100 plug block
101 body
102 fitting portion
120 plug contact
120P, 220P power contact
120S, 220S signal contact

121, 221, 233 connection portion
121*a* concave end
122, 224 first contact portion
123, 223 second contact portion
124 coupling portion
125 recess
130 plug fixture
131 connection portion
132 body
200 housing
201 bottom wall
202 peripheral wall
202*a* side wall
202*b* coupling wall
203 recess
204 insertion portion
204P insertion portion
204S insertion portion
204*a* inclined face
204*b* engagement groove
220 receptacle contact
222 holding portion
225 coupling portion
226 elastic portion
230 receptacle fixture
231 body
232 protruding piece

What is claimed is:

1. A plug connector mounted on a board and that mates with a receptacle connector, the plug connector comprising:
at least three signal contacts and two power contacts each comprising:
a contact portion that contacts the receptacle connector; and
a block that holds the signal contacts and the power contacts, wherein the block comprises:
a body; and
a fitting portion that protrudes away from the body and is inserted into a fitting port of the receptacle connector,
the signal contacts and the power contacts are disposed alternately in a row along an arrangement direction and symmetrically about a line that passes through a center position of the plug connector and is orthogonal to the arrangement direction when viewed from a fitting direction to the receptacle connector, and
a width dimension of each of the power contacts in the arrangement direction is greater than a width dimension of each of the signal contacts in the arrangement direction.

2. The plug connector according to claim 1, wherein
the body of the block is formed on a board side,
the fitting portion protrudes further away from the board than does the body, and
connection portions of the signal contacts and connection portions of the power contacts protrude in a width direction that is orthogonal to the fitting direction and the arrangement direction in a staggered manner in the arrangement direction.

3. The plug connector according to claim 1, further comprising:
fixtures on both ends in the arrangement direction, wherein a connection portion of each of the fixtures protrudes in the arrangement direction from a corresponding end of the plug connector.

4. The plug connector according to claim 2, further comprising:
fixtures on both ends in the arrangement direction, wherein
a connection portion of each of the fixtures protrudes in the arrangement direction from a corresponding end of the plug connector.

5. A receptacle connector mounted on a board and that mates with a plug connector, the receptacle connector comprising:
at least three signal contacts and two power contacts each comprising:
a contact portion that contacts the plug connector;
a connection portion;
a curved elastic portion between the contact portion and the connection portion; and
a housing that holds the signal contacts and the power contacts, wherein the housing comprises:
a bottom wall;
two side walls that protrude away from the bottom wall and extend along an arrangement direction; and
two coupling walls that protrude away from the bottom wall and that couple the two side walls,
the bottom wall, the two side walls, and the two coupling walls form a fitting port into which a fitting portion of the plug connector is inserted,
the contact portion, the elastic portion, and the connection portion are disposed in this sequence in a direction in which each of the contact portion, the elastic portion, and the connection portion extends,
the curved elastic portion comprises a holding portion that is held by the housing on a side of the connection portion,
the signal contacts and the power contacts are disposed alternately in a row along the arrangement direction and symmetrically about a line that passes through a center position of the receptacle connector and is orthogonal to the arrangement direction when viewed from a fitting direction to the plug connector, and
a width dimension of each of the power contacts in the arrangement direction is greater than a width dimension of each of the signal contacts in the arrangement direction.

6. The receptacle connector according to claim 5, wherein
the bottom wall of the housing is substantially parallel to the board,
the two side walls and the two coupling walls protrude further away from the board than does the bottom wall, and
the connection portions of the signal contacts and the connection portions of the power contacts protrude in a width direction that is orthogonal to the fitting direction and the arrangement direction in a staggered manner in the arrangement direction.

7. An electric connector, comprising:
a plug connector; and
a receptacle connector, wherein
the plug connector detachably fits in the receptacle connector,
the plug connector is mounted on a plug board, mates with the receptacle connector, and comprises:
at least three signal contacts and two power contacts each comprising:
a contact portion that contacts the receptacle connector; and a block that holds the signal contacts and the power contacts, wherein the block comprises:

a body; and a fitting portion that protrudes away from the body and is inserted into a fitting port of the receptacle connector, the signal contacts and the power contacts are disposed alternately in a row along an arrangement direction and symmetrically about a line that passes through a center position of the plug connector and is orthogonal to the arrangement direction when viewed from a fitting direction to the receptacle connector, and a width dimension of each of the power contacts in the arrangement direction is greater than a width dimension of each of the signal contacts in the arrangement direction, and the receptacle connector is mounted on a receptacle board, mates with the plug connector, and comprises:

at least three signal contacts and two power contacts each comprising:

a contact portion that contacts the plug connector;

a connection portion;

a curved elastic portion between the contact portion and the connection portion; and a housing that holds the signal contacts and the power contacts, wherein the housing comprises:

a bottom wall;

two side walls that protrude away from the bottom wall and extend along an arrangement direction; and two coupling walls that protrude away from the bottom wall and that couple the two side walls, the bottom wall, the two side walls, and the two coupling walls form a fitting port into which a fitting portion of the plug connector is inserted, the contact portion, the elastic portion, and the connection portion are disposed in this sequence in a direction in which each of the contact portion, the elastic portion, and the connection portion extends, the curved elastic portion comprises a holding portion that is held by the housing on a side of the connection portion, the signal contacts and the power contacts are disposed alternately in a row along the arrangement direction and symmetrically about a line that passes through a center position of the receptacle connector and is orthogonal to the arrangement direction when viewed from a fitting direction to the plug connector, and a width dimension of each of the power contacts in the arrangement direction is greater than a width dimension of each of the signal contacts in the arrangement direction.

8. The electric connector according to claim 7, wherein the plug connector is characterized in that:

the body of the block is formed on a board side, the fitting portion protrudes further away from the plug board than does the body, and connection portions of the signal contacts and connection portions of the power contacts protrude in a width direction that is orthogonal to the fitting direction to the receptacle connector and the arrangement direction in a staggered manner in the arrangement direction.

9. The electric connector according to claim 7, wherein the plug connector further comprises fixtures on both ends in the arrangement direction, and a connection portion of each of the fixtures protrudes in the arrangement direction.

10. The electric connector according to claim 8, wherein the plug connector comprises fixtures on both ends in the arrangement direction, the fixtures each comprise a connection portion that is mounted on the plug board, and the connection portion of each of the fixtures protrudes in the arrangement direction.

11. The electric connector according to claim 7, wherein the receptacle connector is characterized in that:

the bottom wall of the housing is substantially parallel to the receptacle board, the two side walls and the two coupling walls protrude further away from the receptacle board than does the bottom wall, and the connection portions of the signal contacts and the connection portions of the power contacts protrude in a width direction that is orthogonal to the fitting direction to the plug connector and the arrangement direction in a staggered manner in the arrangement direction.

12. The electric connector according to claim 8, wherein the receptacle connector is characterized in that:

the bottom wall of the housing is substantially parallel to the receptacle board, the two side walls and the two coupling walls protrude further away from the receptacle board than does the bottom wall, and the connection portions of the signal contacts and the connection portions of the power contacts protrude in a width direction that is orthogonal to the fitting direction to the plug connector and the arrangement direction in a staggered manner in the arrangement direction.

13. The electric connector according to claim 9, wherein the receptacle connector is characterized in that:

the bottom wall of the housing is substantially parallel to the receptacle board, the two side walls and the two coupling walls protrude further away from the receptacle board than does the bottom wall, and the connection portions of the signal contacts and the connection portions of the power contacts protrude in a width direction that is orthogonal to the fitting direction to the plug connector and the arrangement direction in a staggered manner in the arrangement direction.

14. The electric connector according to claim 10, wherein the receptacle connector is characterized in that:

the bottom wall of the housing is substantially parallel to the receptacle board, the two side walls and the two coupling walls protrude further away from the receptacle board than does the bottom wall, and the connection portions of the signal contacts and the connection portions of the power contacts protrude in a width direction that is orthogonal to the fitting direction to the plug connector and the arrangement direction in a staggered manner in the arrangement direction.

* * * * *